US011317495B2

(12) United States Patent
Miskin et al.

(10) Patent No.: US 11,317,495 B2
(45) **Date of Patent: *Apr. 26, 2022**

(54) LED CIRCUITS AND ASSEMBLIES

(71) Applicant: Lynk Labs, Inc., Elgin, IL (US)

(72) Inventors: Michael Miskin, Sleepy Hollow, IL (US); Robert L. Kottritsch, Shefford (GB)

(73) Assignee: Lynk Labs, Inc., Elgin, IL (US)

( * ) Notice: Subject to any disclaimer, the term of this patent is extended or adjusted under 35 U.S.C. 154(b) by 4 days.

This patent is subject to a terminal disclaimer.

(21) Appl. No.: 17/233,891

(22) Filed: Apr. 19, 2021

(65) Prior Publication Data

US 2021/0243868 A1 Aug. 5, 2021

Related U.S. Application Data

(63) Continuation of application No. 15/334,001, filed on Oct. 25, 2016, now Pat. No. 10,986,714, which is a (Continued)

(51) Int. Cl.
*H05B 45/42* (2020.01)
*H05B 45/40* (2020.01)
*H05B 45/37* (2020.01)

(52) U.S. Cl.
CPC ..... *H05B 45/42* (2020.01); *H05B 45/37* (2020.01); *H05B 45/40* (2020.01); *Y10T 29/49002* (2015.01)

(58) Field of Classification Search
CPC ..... H05B 45/42; H05B 45/37; H05B 45/40; Y10T 29/49002
See application file for complete search history.

(56) References Cited

U.S. PATENT DOCUMENTS 3,582,932 A 6/1971 Chapman
3,712,706 A 1/1973 Stamm
(Continued)

FOREIGN PATENT DOCUMENTS

AU 2003100206 4/2003
AU 200310026 7/2003
(Continued)

OTHER PUBLICATIONS

U.S. Pat. No. 10,091,842 ("842 Patent")—Exhibit G-01 Bruning.
(Continued)

*Primary Examiner* — Daniel D Chang
(74) *Attorney, Agent, or Firm* — K&L Gates LLP

(57) ABSTRACT

An LED lighting device is disclosed. The LED lighting device includes an LED circuit having at least two LEDs that are mounted on a substrate and separated from each other by a distance of 3 millimeters or less. At least one of the at least two LEDs includes a different phosphor coating than that of at least one other LED of the at least two LEDs. The LED lighting device also includes a switch selectable by an end user to enable a change in a color of light emitted from the LED lighting device by causing one of at least a change in brightness or turning 'on' or 'off' the at least one LED with the different phosphor coating of the at least two LEDs in the LED circuit. The substrate and the switch are integrated within the LED lighting device.

20 Claims, 5 Drawing Sheets

Related U.S. Application Data continuation-in-part of application No. 14/172,644, filed on Feb. 4, 2014, now Pat. No. 9,750,098, which is a continuation of application No. 13/322,796, filed as application No. PCT/US2010/001597 on May 28, 2010, now Pat. No. 8,648,539, which is a continuation-in-part of application No. 12/287,267, filed on Oct. 6, 2008, now Pat. No. 8,179,055.

(60) Provisional application No. 61/217,215, filed on May 28, 2009, provisional application No. 60/997,771, filed on Oct. 6, 2007.

(56) References Cited

U.S. PATENT DOCUMENTS

| | | | |
|---|---|---|---|
| 3,821,662 | A | 6/1974 | Dewinter et al. |
| 3,981,023 | A | 9/1976 | King et al. |
| 4,104,562 | A | 8/1978 | DiCola |
| 4,145,655 | A | 3/1979 | Caudel et al. |
| 4,170,018 | A | 10/1979 | Runge |
| 4,246,533 | A | 1/1981 | Chiang |
| 4,271,408 | A | 6/1981 | Teshima et al. |
| 4,298,869 | A | 11/1981 | Okano |
| 4,350,973 | A | 9/1982 | Petryk, Jr. |
| 4,530,973 | A | 7/1985 | Koster et al. |
| 4,563,592 | A | 1/1986 | Yuhasz et al. |
| 4,573,766 | A | 3/1986 | Bournay, Jr. et al. |
| 4,653,895 | A | 3/1987 | Deguchi et al. |
| 4,654,880 | A | 3/1987 | Sontag |
| 4,646,398 | A | 4/1987 | Michael et al. |
| 4,656,398 | A | 4/1987 | Michael et al. |
| 4,691,341 | A | 9/1987 | Knoble et al. |
| 4,780,621 | A | 10/1988 | Bartleucci et al. |
| 4,797,651 | A | 1/1989 | Havel |
| 4,816,698 | A | 3/1989 | Hook |
| RE33,285 | E | 7/1990 | Kunen |
| 4,962,347 | A | 10/1990 | Burroughs et al. |
| 5,010,459 | A | 4/1991 | Taylor et al. |
| 5,014,052 | A | 5/1991 | Obeck |
| 5,028,859 | A | 7/1991 | Johnson et al. |
| 5,086,294 | A | 2/1992 | Kasegi |
| 5,267,134 | A | 11/1993 | Banayan |
| 5,278,432 | A | 1/1994 | Ignatius et al. |
| 5,293,494 | A | 3/1994 | Saito et al. |
| 5,324,316 | A | 6/1994 | Schulman et al. |
| 5,353,213 | A | 10/1994 | Paulik et al. |
| 5,408,330 | A | 4/1995 | Squicciarini et al. |
| 5,430,609 | A | 7/1995 | Kikinis |
| 5,457,450 | A | 10/1995 | Deese et al. |
| 5,463,280 | A | 10/1995 | Johnson |
| 5,519,263 | A | 5/1996 | Santana, Jr. |
| 5,521,652 | A | 5/1996 | Shalvi |
| 5,532,641 | A | 7/1996 | Balasubramanian et al. |
| 5,562,240 | A | 10/1996 | Campbell |
| 5,596,567 | A | 1/1997 | DeMuro et al. |
| 5,621,225 | A | 4/1997 | Shieh et al. |
| 5,652,609 | A | 7/1997 | Scholler et al. |
| 5,657,054 | A | 8/1997 | Files et al. |
| 5,661,645 | A | 8/1997 | Hochstein |
| 5,663,719 | A | 9/1997 | Deese et al. |
| 5,684,738 | A | 11/1997 | Au et al. |
| 5,739,639 | A | 4/1998 | Johnson |
| 5,785,418 | A | 7/1998 | Hochstein |
| 5,790,106 | A | 8/1998 | Hirano et al. |
| 5,806,965 | A | 9/1998 | Deese |
| 5,828,768 | A | 10/1998 | Eatwell et al. |
| 5,847,507 | A | 12/1998 | Butterworth et al. |
| 5,874,803 | A | 2/1999 | Garbuzov et al. |
| 5,923,239 | A | 7/1999 | Krueger et al. |
| 5,946,348 | A | 8/1999 | Mizutani et al. |
| 5,963,012 | A | 10/1999 | Garcia et al. |
| 5,965,907 | A | 10/1999 | Huang et al. |
| 5,973,677 | A | 10/1999 | Gibbons |
| 5,982,103 | A | 11/1999 | Mosebrook et al. |
| 5,998,925 | A | 12/1999 | Shimizu et al. |
| 6,016,038 | A | 1/2000 | Mueller et al. |
| 6,019,493 | A | 2/2000 | Kuo et al. |
| 6,023,073 | A | 2/2000 | Strite |
| 6,061,259 | A | 5/2000 | DeMichele |
| 6,078,148 | A | 6/2000 | Hochstein |
| 6,164,368 | A | 12/2000 | Furukawa et al. |
| 6,184,628 | B1 | 2/2001 | Ruthenberg |
| 6,227,679 | B1 | 5/2001 | Zhang et al. |
| 6,246,169 | B1 | 6/2001 | Pruvot |
| 6,265,984 | B1 | 7/2001 | Molinaroli |
| 6,292,901 | B1 | 9/2001 | Lys et al. |
| 6,300,725 | B1 | 10/2001 | Zinkler et al. |
| 6,300,748 | B1 | 10/2001 | Miller |
| 6,303,238 | B1 | 10/2001 | Thompson et al. |
| 6,307,757 | B1 | 10/2001 | Porter et al. |
| 6,319,778 | B1 | 11/2001 | Chen et al. |
| 6,323,652 | B1 | 11/2001 | Collier et al. |
| 6,324,082 | B1 | 11/2001 | Keller |
| 6,329,694 | B1 | 12/2001 | Lee et al. |
| 6,361,886 | B2 | 3/2002 | Shi et al. |
| 6,362,789 | B1 | 3/2002 | Trumbull et al. |
| 6,380,693 | B1 | 4/2002 | Kastl |
| 6,396,801 | B1 | 5/2002 | Upton et al. |
| 6,404,131 | B1 | 6/2002 | Kawano et al. |
| 6,411,045 | B1 | 6/2002 | Nerone |
| 6,412,971 | B1 | 7/2002 | Wojnarowski et al. |
| 6,439,731 | B1 | 8/2002 | Johnson et al. |
| 6,441,558 | B1 | 8/2002 | Muthu et al. |
| 6,456,481 | B1 | 9/2002 | Stevenson |
| 6,466,198 | B1 | 10/2002 | Feinstein |
| 6,489,724 | B1 | 12/2002 | Smith et al. |
| 6,489,754 | B2 | 12/2002 | Blom |
| 6,501,100 | B1 | 12/2002 | Srivastava et al. |
| 6,507,159 | B2 | 1/2003 | Muthu |
| 6,510,995 | B2 | 1/2003 | Muthu et al. |
| 6,529,126 | B1 | 3/2003 | Henry |
| 6,541,800 | B2 | 4/2003 | Barnett |
| 6,577,072 | B2 | 6/2003 | Saito et al. |
| 6,580,228 | B1 | 6/2003 | Chen et al. |
| 6,600,243 | B1 | 7/2003 | Hara et al. |
| 6,618,042 | B1 | 9/2003 | Powell |
| 6,633,120 | B2 | 10/2003 | Salam |
| 6,636,005 | B2 | 10/2003 | Wacyk et al. |
| 6,643,336 | B1 | 11/2003 | Hsieh et al. |
| 6,663,246 | B2 | 12/2003 | Currens et al. |
| 6,664,744 | B2 | 12/2003 | Dietz |
| 6,686,697 | B2 | 2/2004 | Cho et al. |
| 6,689,626 | B2 | 2/2004 | Krijn et al. |
| 6,717,353 | B1 | 4/2004 | Mueller et al. |
| 6,722,771 | B1 | 4/2004 | Stephens |
| 6,774,582 | B1 | 8/2004 | Kwong et al. |
| 6,781,329 | B2 | 8/2004 | Mueller et al. |
| 6,803,732 | B2 | 10/2004 | Kraus et al. |
| 6,814,642 | B2 | 11/2004 | Siwinski et al. |
| 6,832,729 | B1 | 12/2004 | Perry et al. |
| 6,844,675 | B2 | 1/2005 | Yang |
| 6,850,169 | B2 | 2/2005 | Manavi et al. |
| 6,856,103 | B1 | 2/2005 | Hudson et al. |
| 6,879,319 | B2 | 4/2005 | Cok |
| 6,879,497 | B2 | 4/2005 | Hua et al. |
| 6,882,128 | B1 | 4/2005 | Rahmel et al. |
| 6,891,786 | B2 | 5/2005 | Sato |
| 6,907,089 | B2 | 6/2005 | Jensen et al. |
| 6,936,936 | B2 | 8/2005 | Fischer et al. |
| 6,949,772 | B2 | 9/2005 | Shimizu et al. |
| 6,988,053 | B2 | 1/2006 | Namaky |
| 7,019,662 | B2 | 3/2006 | Shackle |
| 7,038,399 | B2 | 5/2006 | Lys et al. |
| 7,044,627 | B2 | 5/2006 | Mertz et al. |
| 7,161,590 | B2 | 1/2007 | Daniels |
| 7,176,885 | B2 | 2/2007 | Troxell et al. |
| 7,180,265 | B2 | 2/2007 | Maskali et al. |
| 7,202,613 | B2 | 4/2007 | Morgan et al. |
| 7,213,940 | B1 | 5/2007 | Van De Ven et al. |
| 7,226,442 | B2 | 6/2007 | Sheppard, Jr. et al. |
| 7,226,644 | B2 | 6/2007 | Sheppard, Jr. et al. |
| 7,262,559 | B2 | 8/2007 | Tripathi et al. |
| 7,264,378 | B2 | 9/2007 | Loh |

(56) References Cited

U.S. PATENT DOCUMENTS 7,271,568 B2 9/2007 Purdy et al.
7,348,957 B2 3/2008 Cui et al.
7,375,476 B2 5/2008 Scott et al.
7,489,086 B2 2/2009 Miskin et al.
7,583,901 B2 9/2009 Nakagawa et al.
7,852,009 B2 12/2010 Coleman et al.
RE42,161 E 2/2011 Hochstein
7,888,888 B2 2/2011 Huang et al.
8,055,310 B2 11/2011 Beart et al.
8,080,819 B2 12/2011 Mueller et al.
8,148,905 B2 4/2012 Miskin et al.
8,179,055 B2 5/2012 Miskin et al.
8,326,225 B2 12/2012 Oba et al.
8,362,695 B2 1/2013 Aanegola et al.
8,373,363 B2 2/2013 Zdenko
8,378,374 B2 * 2/2013 Loh ..... H01L 33/62 257/99
8,400,081 B2 3/2013 Catalano et al.
8,471,495 B2 6/2013 Muguruma et al.
8,587,205 B2 11/2013 Ter Weeme et al.
9,112,957 B2 8/2015 Beart et al.
9,198,237 B2 * 11/2015 Miskin ..... H05B 45/42
9,615,420 B2 4/2017 Miskin
9,807,827 B2 10/2017 Miskin et al.
10,091,842 B2 10/2018 Miskin et al.
10,154,551 B2 12/2018 Miskin
10,178,715 B2 1/2019 Miskin et al.
10,349,479 B2 7/2019 Miskin et al.
10,492,251 B2 11/2019 Miskin et al.
10,492,252 B2 11/2019 Miskin et al.
10,499,466 B1 12/2019 Miskin et al.
10,506,674 B2 12/2019 Miskin et al.
10,517,149 B2 12/2019 Miskin et al.
10,537,001 B2 1/2020 Miskin et al.
10,575,376 B2 2/2020 Miskin et al.
10,687,400 B2 6/2020 Miskin et al.
10,750,583 B2 8/2020 Miskin et al.
10,757,783 B2 8/2020 Miskin et al.
10,932,341 B2 2/2021 Miskin et al.
10,966,298 B2 3/2021 Miskin et al.
11,019,697 B2 5/2021 Miskin et al.
2001/0005319 A1 6/2001 Ohishi et al.
2002/0014630 A1 2/2002 Okazaki et al.
2002/0021573 A1 2/2002 Zhang
2002/0030193 A1 3/2002 Yamazaki et al.
2002/0030194 A1 3/2002 Camras et al.
2002/0048169 A1 4/2002 Dowling et al.
2002/0048177 A1 4/2002 Rahm et al.
2002/0060530 A1 5/2002 Sembhi et al.
2002/0070914 A1 6/2002 Bruning et al.
2002/0072395 A1 6/2002 Miramontes
2002/0080010 A1 6/2002 Zhang
2002/0081982 A1 6/2002 Schwartz et al.
2002/0086702 A1 7/2002 Lai et al.
2002/0113244 A1 8/2002 Barnett et al.
2002/0113246 A1 8/2002 Nagai et al.
2002/0118557 A1 8/2002 Ohlsson
2002/0130627 A1 9/2002 Morgan
2002/0137258 A1 9/2002 Akram
2002/0145392 A1 10/2002 Hair et al.
2002/0149572 A1 10/2002 Schulz et al.
2002/0158590 A1 10/2002 Saito et al.
2002/0163006 A1 11/2002 Sundar et al.
2002/0167016 A1 11/2002 Hoelen et al.
2002/0175870 A1 11/2002 Gleener
2002/0176259 A1 11/2002 Ducharme
2002/0187675 A1 12/2002 McMullin et al.
2002/0191029 A1 12/2002 Gillespie et al.
2002/0195968 A1 12/2002 Sanford et al.
2003/0001657 A1 1/2003 Worley, Sr. et al.
2003/0011972 A1 1/2003 Koo
2003/0015968 A1 1/2003 Allen
2003/0020629 A1 1/2003 Swartz et al.
2003/0035075 A1 2/2003 Butler et al.
2003/0038291 A1 2/2003 Cao
2003/0043611 A1 3/2003 Bockle et al.
2003/0063462 A1 4/2003 Shimizu et al.
2003/0072145 A1 4/2003 Nolan et al.
2003/0076306 A1 4/2003 Zadesky et al.
2003/0085621 A1 5/2003 Potega
2003/0085870 A1 5/2003 Hinckley
2003/0102810 A1 6/2003 Cross et al.
2003/0122502 A1 7/2003 Clauberg et al.
2003/0137258 A1 7/2003 Piepgras et al.
2003/0144034 A1 7/2003 Hack et al.
2003/0146897 A1 8/2003 Hunter
2003/0185005 A1 10/2003 Sommers et al.
2003/0230934 A1 12/2003 Cordelli et al.
2003/0231168 A1 12/2003 Bell et al.
2003/0234621 A1 12/2003 Kriparos
2004/0022058 A1 2/2004 Birrell
2004/0041620 A1 3/2004 D'Angelo et al.
2004/0108997 A1 6/2004 Lee
2004/0130909 A1 7/2004 Mueller et al.
2004/0150994 A1 8/2004 Kazar et al.
2004/0164948 A1 8/2004 Kabel et al.
2004/0206970 A1 10/2004 Martin
2004/0207484 A1 10/2004 Forrester et al.
2004/0212321 A1 10/2004 Lys et al.
2004/0263084 A1 12/2004 Mor et al.
2004/0266349 A1 12/2004 Wang
2005/0001225 A1 1/2005 Yoshimura et al.
2005/0058852 A1 3/2005 Tyan et al.
2005/0078093 A1 4/2005 Peterson, Jr. et al.
2005/0111234 A1 5/2005 Martin et al.
2005/0116235 A1 6/2005 Schultz et al.
2005/0128751 A1 6/2005 Roberge et al.
2005/0185401 A1 8/2005 Jiang et al.
2005/0231133 A1 10/2005 Lys
2005/0276053 A1 12/2005 Nortrup et al.
2006/0091415 A1 5/2006 Yan
2006/0099994 A1 5/2006 Yang et al.
2006/0163589 A1 7/2006 Fan et al.
2006/0226795 A1 10/2006 Walter et al.
2007/0024213 A1 2/2007 Shteynberg et al.
2007/0171145 A1 7/2007 Coleman et al.
2007/0273299 A1 11/2007 Miskin et al.
2007/0290625 A1 12/2007 Xi
2008/0218995 A1 9/2008 Gilkey
2009/0017433 A1 1/2009 Belsky et al.
2009/0160358 A1 6/2009 Slava
2009/0167202 A1 7/2009 Miskin et al.
2009/0174337 A1 7/2009 Miskin et al.
2010/0134038 A1 6/2010 Shackle
2010/0141177 A1 6/2010 George
2011/0193484 A1 8/2011 Harbers et al.
2011/0273098 A1 11/2011 Grajcar
2012/0069560 A1 3/2012 Miskin et al.
2012/0081009 A1 4/2012 Shteynberg et al.
2012/0293083 A1 11/2012 Miskin et al.
2013/0051001 A1 2/2013 Miskin
2014/0153232 A1 6/2014 Miskin et al.
2014/0361697 A1 12/2014 Miskin et al.
2016/0095180 A1 3/2016 Miskin
2016/0143097 A1 5/2016 Miskin
2016/0188426 A1 6/2016 Kousha et al.
2017/0208656 A1 * 7/2017 Miskin ..... H05B 45/39
2017/0354005 A1 12/2017 Miskin et al.
2019/0045593 A1 2/2019 Miskin et al.
2019/0182919 A1 6/2019 Miskin et al.
2019/0268982 A1 8/2019 Miskin et al.
2019/0306940 A1 10/2019 Miskin et al.
2019/0313491 A1 10/2019 Miskin et al.
2019/0350053 A1 11/2019 Miskin et al.

FOREIGN PATENT DOCUMENTS

AU 2003100206 7/2003
AU 2003100206 7/2013
CN 1341966 A 3/2002
EP 0515664 12/1992
EP 1502483 2/2005
EP 1 953 825 B1 8/2008
EP 1953825 8/2008

(56) References Cited

FOREIGN PATENT DOCUMENTS

| | | | |
|---|---|---|---|
| EP | 1160883 | | 12/2011 |
| EP | 1953825 | B1 | 7/2013 |
| GB | 2202414 | | 9/1988 |
| GB | 2202414 | A | 9/1988 |
| GB | 2264555 | | 9/1993 |
| GB | 237609 | | 8/2002 |
| IL | 123123 | | 3/2004 |
| JP | H08149063 | | 6/1996 |
| JP | 200050512 | | 2/2000 |
| JP | 2000278383 | A | 10/2000 |
| JP | 2000030877 | | 1/2001 |
| JP | 2001004753 | A | 1/2001 |
| JP | 201176677 | | 6/2001 |
| JP | 2001284065 | | 12/2001 |
| JP | 2002050798 | A | 2/2002 |
| JP | 2002208301 | A | 7/2002 |
| JP | 2003047177 | A | 2/2003 |
| JP | 2004-111104 | | 4/2004 |
| JP | 2005-524960 | | 8/2005 |
| JP | 2005-524960 | A | 8/2005 |
| JP | 2011-040701 | A | 2/2011 |
| JP | 2011040701 | | 2/2011 |
| JP | 201159495 | | 8/2011 |
| KR | 100367215 | B1 | 1/2003 |
| KR | 20030073747 | A | 9/2003 |
| WO | 9750168 | | 12/1997 |
| WO | 1997050168 | | 12/1997 |
| WO | 9939319 | | 8/1999 |
| WO | 0101385 | | 1/2001 |
| WO | 2001001385 | | 1/2001 |
| WO | 0221741 | | 3/2002 |
| WO | 0223956 | | 3/2002 |
| WO | 0223959 | | 3/2002 |
| WO | 2002023956 | | 3/2002 |
| WO | WO02/23956 | | 3/2002 |
| WO | 0231406 | | 4/2002 |
| WO | 02062623 | | 8/2002 |
| WO | 03009535 | A1 | 1/2003 |
| WO | 03/026358 | | 3/2003 |
| WO | 2004055654 | A2 | 7/2004 |
| WO | 2005084080 | | 9/2005 |
| WO | 2006023149 | | 3/2006 |
| WO | 2010016002 | | 2/2010 |
| WO | 2010138211 | | 2/2010 |
| WO | 2010035155 | | 4/2010 |
| WO | 2010103480 | | 9/2010 |
| WO | 2010126601 | | 11/2010 |
| WO | 20101266011 | | 11/2010 |
| WO | 201018211 | | 12/2010 |
| WO | 2010138211 | | 12/2010 |
| WO | 20100138211 | | 12/2010 |
| WO | 2011082168 | | 7/2011 |
| WO | 2011/143510 | | 11/2011 |
| WO | 2011143510 | | 11/2011 |
| WO | 20110143510 | | 11/2011 |
| WO | 213026053 | | 2/2013 |
| WO | 2013026053 | | 2/2013 |
| WO | 2013082609 | | 6/2013 |

OTHER PUBLICATIONS

U.S. Pat. No. 10,091,842 ("842 Patent")—Exhibit G-02 Ohishi '319.
U.S. Pat. No. 10,091,842 ("842 Patent")—Exhibit G-03 Ruxton.
U.S. Pat. No. 10,091,842 ("842 Patent")—Exhibit G-04 Walding.
U.S. Pat. No. 10,091,842 ("842 Patent")—Exhibit G-05 Bohn.
U.S. Pat. No. 10,091,842 ("842 Patent")—Exhibit G-06 Dowling.
U.S. Pat. No. 10,537,001 ("001 Patent")—Exhibit H-01 Dowling.
U.S. Pat. No. 10,537,001 ("001 Patent")—Exhibit H-02 Lys '321.
U.S. Pat. No. 10,537,001 ("001 Patent")—Exhibit H-03 Miskin.
U.S. Pat. No. 10,537,001 ("001 Patent")—Exhibit H-04 Leong '003.
U.S. Pat. No. 10,537,001 ("001 Patent")—Exhibit H-05 Konno.
U.S. Pat. No. 10,932,341 ("341 Patent")—Exhibit I-01 Ohishi '009.
U.S. Pat. No. 10,932,341 ("341 Patent")—Exhibit I-02 Muthu '558.
U.S. Pat. No. 10,932,341 ("341 Patent")—Exhibit I-03 Dowling.
U.S. Pat. No. 10,932,341 ("341 Patent")—Exhibit I-04 Konno.
U.S. Pat. No. 10,932,341 ("341 Patent")—Exhibit I-05 Leong '003.
U.S. Pat. No. 10,932,341 ("341 Patent")—Exhibit I-06 Reymond.
"White Light Emitting Diode Devlopment for General Illumination Applications" to James Ibbetson, published on May 1, 2006 ("Ibbetson").
Petiion for Inter Partes Review, *Home Depot USA, Inc.*, Petitioner, v. *Lynk Labs, Inc.*, Patent Owner, Case IPR2021-001367 U.S. Pat. No. 10,154,551, dated Dec. 11, 2018, Title: "AC Light Emitting Diode and AC LED Drive Methods and Apparatus," 93 pages dated Aug. 18, 2021.
Petitioners' Power of Attorney, *Home Depot USA, Inc.*, v. *Lynk Labs, Inc.*, Patent Owner, Case IPR2021-001367 U.S. Pat. No. 10,154,551, dated Dec. 11, 2018, Title: "AC Light Emitting Diode and AC LED Drive Methods and Apparatus," 2 pages dated Aug. 17, 2021.
Declaration of Dr. Dean Neikirk—U.S. Pat. No. 10,154,551, Claims 1, 3, 4, 5, 7, 8—141 pages—Ex 1002.
U.S. Appl. No. 15/797,806—Now U.S. Pat. No. 10,154,551—Ex 1003.
U.S. Appl. No. 11/066,414—Now U.S. Pat. No. 7,489,086 filed Feb. 10, 2009—Ex 1005.
IEEE 100, The Authoriative Dictionay of IEEE Standard Terms—Seventh Editon, 3 pages—Ex 1010.
Complaint for Patent Infringement *Lynk Labs, Inc.* Plaintiff v. *Home Depot USA, Inc., The Home Depot Inc., and Home Depot Product Authority, LLC* Defendants, Case No. 6:21-cv-00097, filed Jan. 20, 2021—Ex. 1011.
Azazi et al., "Review of Passive and Active Circuits for Power Factor Correction in Single Phase, Low Power AC-DC Converters," Proceedings of the 14th International Middle East Power Systems Conference (MEPCON'10) Cairo University, Egypt, Dec. 19-21, 2010, Paper ID 154, 8 pages—Ex 1016.
U.S. Appl. No. 60/547,653, filed Feb. 25, 2004—Ex 1017.
U.S. Appl. No. 60/559,867, filed Feb. 25, 2004—Ex 1018.
U.S. Appl. No. 60/997,771, filed Oct. 6, 2007—Ex 1019.
U.S. Appl. No. 61/215,144, filed May 1, 2009—Ex 1022.
U.S. Appl. No. 61/217,215, filed May 28, 2009—Ex 1023.
U.S. Appl. No. 61/284,927, filed Dec. 28, 2009—Ex 1024.
U.S. Appl. No. 61/335,069, filed Dec. 31, 2009—Ex 1025.
U.S. Appl. No. 61/333,963, filed May 12, 2010—Ex 1026.
Plaintiff Lynk Labs, Inc.'s Amended Preliminary Infringement Contentions, Case No. 6:21-cv-00097-ADA filed Jun. 23, 2021, 7 pages—Ex 1034.
U.S. Appl. No. 60/379,079, filed May 9, 2002—Ex 1035.
U.S. Appl. No. 60/391,627, filed Jun. 26, 2002—Ex 1036.
Institute of Transportation Engineers Publication No. ST-017B, 1997 ISBN: 0-935403-16-7, ITE Specification (183369415.1), Chapter 2 Vehicle Traffic Control Signal Heads, 25 pages—Ex 1038
Osorno, "Fourier Analysis of a Single-Phase Full Bridge Rectifier Using Matlab," California State University Northridge, 2002-774, 9 pages—Ex 1039.
Scheduling Order *Lynk Labs, Inc.* Plaintiff v. *Home Depot USA, Inc., The Home Depot Inc., and Home Depot Product Authority, LLC* Defendants, Case No. 6:21-cv-00097, filed Aug. 13, 2021—Ex. 1040.
Vachak et al., "Power Factor Correction Circuits: Active Filters," International Journal of Engineering Research and General Science, vol. 2, Issue 5, Aug.-Sep. 2014, ISSAN 2091-2730, 9 pages—Ex 1041.
*Samsung Electronics Co. Ltd. and Samsung Electronics America, Inc.* v. *Lynk Labs, Inc.* Case No. 1:21-cv-02665, Samsung's Inital Non-Infringement, Unenforceability, and Invalidity Contentions dated Sep. 21, 2021—85 pages.
U.S. Pat. No. 10,492,251 (251 Patent)—Exhibit A-01—Lys '262.
U.S. Pat. No. 10,492,251 (251 Patent)—Exhibit A-02—KR '747.
U.S. Pat. No. 10,492,251 (251 Patent)—Exhibit A-03—KR '215.
U.S. Pat. No. 10,492,251 (251 Patent)—Exhibit A-04—iColor System.
U.S. Pat. No. 10,492,251 (251 Patent)—Exhibit A-05—Miskin '299.

(56) References Cited

OTHER PUBLICATIONS

U.S. Pat. No. 10,492,252 (252 Patent)—Exhibit B-01—Piepgrass.
U.S. Pat. No. 10,492,252 (252 Patent)—Exhibit B-02—Hitachi.
U.S. Pat. No. 10,492,252 (252 Patent)—Exhibit B-03—Mueller.
U.S. Pat. No. 10,492,252 (252 Patent)—Exhibit B-04—NEC.
U.S. Pat. No. 10,492,252 (252 Patent)—Exhibit B-05—Miskin '299.
U.S. Pat. No. 10,492,252 (252 Patent)—Exhibit B-06—Mac Powerbook G3.
U.S. Pat. No. 10,492,252 (252 Patent)—Exhibit B-07—iPod G3.
U.S. Pat. No. 10,492,252 (252 Patent)—Exhibit B-08—iPAQ H5500.
U.S. Pat. No. 10,499,466 (466 Patent)—Exhibit C-01—Piepgrass.
U.S. Pat. No. 10,499,466 (466 Patent)—Exhibit C-02—Hitachi.
U.S. Pat. No. 10,499,466 (466 Patent)—Exhibit C-03—Mueller.
U.S. Pat. No. 10,499,466 (466 Patent)—Exhibit C-04—NEC.
U.S. Pat. No. 10,499,466 (466 Patent)—Exhibit C-05—Miskin '299.
U.S. Pat. No. 10,499,466 (466 Patent)—Exhibit C-06—Mac Powerbook G3.
U.S. Pat. No. 10,499,466 (466 Patent)—Exhibit C-07—iPod G3.
U.S. Pat. No. 10,499,466 (466 Patent)—Exhibit C-08—iPAQ H5500.
U.S. Pat. No. 10,506,674 (674 Patent)—Exhibit D-01—Piepgrass.
U.S. Pat. No. 10,506,674 (674 Patent)—Exhibit D-02—Hitachi.
U.S. Pat. No. 10,506,674 (674 Patent)—Exhibit D-03-Mueller.
U.S. Pat. No. 10,506,674 (674 Patent)—Exhibit D-04—NEC.
U.S. Pat. No. 10,506,674 (674 Patent)—Exhibit D-05—Miskin '299.
U.S. Pat. No. 10,506,674 (674 Patent)—Exhibit D-06—Mac Powerbook G3
U.S. Pat. No. 10,506,674 (674 Patent)—Exhibit D-07—iPod G3.
U.S. Pat. No. 10,506,674 (674 Patent)—Exhibit D-08—iPAQ H5500.
U.S. Pat. No. 10,517,149 (149 Patent)—Exhibit E-01—Lys '626.
U.S. Pat. No. 10,517,149 (149 Patent)—Exhibit E-02—KR '747.
U.S. Pat. No. 10,517,149 (149 Patent)—Exhibit E-03—KR '215.
U.S. Pat. No. 10,517,149 (149 Patent0—Exhibit E-04—iColor Systems.
U.S. Pat. No. 10,517,149 (149 Patent)—Exhibit E-05—Miskin '299.
U.S. Pat. No. 10,687,400 (400 Patent)—Exhibit F-01—Lys '626.
U.S. Pat. No. 10,687,400 (400 Patent)—Exhibit F-02—KR '747.
U.S. Pat. No. 10,687,400 (400 Patent)—Exhibit F-03—CK LEDs.
U.S. Pat. No. 10,687,400 (400 Patent)—Exhibit F-04—Miskin '299.
U.S. Pat. No. 10,750,583 (583 Patent)—Exhibit G-01—Lys '626.
U.S. Pat. No. 10,750,583 (583 Patent)—Exhibit G-02—KR 747.
U.S. Pat. No. 10,750,583 (583 Patent)—Exhibit G-03—KR 215.
U.S. Pat. No. 10,750,583 (583 Patent)—Exhibit G-04—iColor System.
U.S. Pat. No. 10,750,583 (583 Patent)—Exhibit G-05—Piepgrass.
U.S. Pat. No. 10,750,583 (583 Patent)—Exhibit G-06—Miskin '299.
U.S. Pat. No. 10,966,298 (298 Patent)—Exhibit H-01—Piepgrass.
U.S. Pat. No. 10,966,298 (298 Patent)—Exhibit H-02—Hitachi.
U.S. Pat. No. 10,966,298 (298 Patent)—Exhibit H-03—Mueller.
U.S. Pat. No. 10,966,298 (298 Patent)—Exhibit H-04—NEC.
U.S. Pat. No. 10,966,298 (298 Patent)—Exhibit H-05—Miskin '299.
Petition for Inter Partes Review, *Home Deport USA, Inc.*, Petitioner, v. *Lynk Labs, Inc.*, Patent Owner, Case IPR2021-01370 U.S. Pat. No. 10,349,479, dated Jul. 9, 2019, Title: "Color Temperature Controlled and Low THD LED Lighting Devices and Systems and Methods of Driving the Same," 52 pages dated Aug. 18, 2021.
Petitioners' Power of Attorney, *Home Depot USA, Inc.*, Petitioner, v. *Lynk Labs, Inc.*, Patent Owner, Case IPR2021-01370 U.S. Pat. No. 10,349,479, dated Jul. 9, 2019, Title: "Color Temperature Controlled and Low THD LED Lighting Devices and Systems and Methods of Driving the Same," 2 pages dated Aug. 17, 2021.
Declaration of Dr. Dean Neikirk U.S. Pat. No. 10,349,479, Inter Partes Review No. IPR2021-01370, 98 pages—Ex 1002.
U.S. Appl. No. 15/369,218, filed Dec. 5, 2016, 617 pages—Ex. 1003.
U.S. Appl. No. 61/630,025, filed Dec. 2, 2011, 39 pages—Ex. 1011.
U.S. Appl. No. 61/570,200, filed Dec. 13, 2011, 51 pages—Ex 1012.
Complaint for Patent Infringement, Case No. 6:21-cv-00097, *Lynk Labs, Inc.* v. *Home Depot USA, Inc., The Home Depot Inc., and Home Depot Product Authority, LLC*, dated Jan. 29, 2021, 88 pages—Ex 1014.
Plaintiff Amended Preliminary Infringement Contentions, Lynk Lab's, Inc.'s, Case No. 6:21-cv-00097-ADA, *Lynk Labs Inc.* v. *Home Depot USA, Inc., The Home Depot Inc., and Home Depot Product Authority, LLC*, dated Jun. 23, 2021, 7 pages—Ex 1015.
Scheduling Order, Case No. 6:21-cv-00097-ADA, *Lynk Labs, Inc.* v. *Home Depot USA, Inc., The Home Depot Inc., and Home Depot Product Authority, LLC*, filed Aug. 13, 2021, 4 pages—Ex 1016.
Petition for Inter Partes Review, *Home Depot USA, Inc.*, Petitioner. v. *Lynk Labs, Inc.*, Patent Owner, Case IPR2021-001368 U.S. Pat. No. 10,757,783, dated Aug. 25, 2020, Title: "Color Temperature Controlled and Low THD LED Lighting Devices and Driving the Same," 95 pages dated Aug. 18, 2021.
Petitioner' Power of Attorney, *Home Depot USA, Inc.*, Petitioner, v. *Lynk Labs, Inc.*, Patent Owner, Case IPR2021-001368 U.S. Pat. No. 10,757,783, dated Aug. 25, 2020, Title: "Color Temperature Controlled and Low THD LED Lightting Devices and Driving the Same," 2 pages dated Aug. 17, 2021.
Declaration of Dr. Lebby U.S. Pat. No. 10,757,783 dated Aug. 18, 2021, 187 pages—Ex 1002.
U.S. Appl. No. 16/440,884, filed Jun. 13, 2019, 341 pages—Ex 1003.
Institute of Transportation Engineers, Publication No. ST-017B 300/IG/102, ISBN 0-935403-16-7 (1998), 25 pages—Ex 1007.
Complaint for Patent Infringemet *Lynk Labs, Inc.* v. *Home Depot USA Inc., The Home Depot Inc., and Home Depot Product Authority, LLC*, Case No. 6:21-cv-00097, filed Jan. 29, 2021, 86 pages—Ex. 1010.
U.S. Appl. No. 61/630,025, filed Dec. 2, 2011, 39 pages—Ex 1012.
U.S. Appl. No. 61/570,200, filed Dec. 13, 2011, 51 pages—Ex 1013.
Plaintiff Lynk Labs, Inc.'s Amended Preliminary Infringement Contentions, Case No. 6:21-cv-00097-ADA, dated Jun. 23, 2021, 7 pages—Ex. 1019.
Okon et al., "The First Practical LED", Received: Nov. 9, 2015, 14 pages—Ex 1020.
Scheduling Order, Case No. 6:21-cv-00097-ADA filed Aug. 13, 2021, 4 pages—Ex 1021.
U.S. Appl. No. 61/233,829, filed Aug. 14, 2009, 36 pages—Ex 1022.
*Samsung Electronics Co., Ltd.* v. *Lynk Labs, Inc.* U.S. Pat. No. 10,750,583, Petition for Inter Partes Review of U.S. Pat. No. 10,750,583 dated Oct. 28, 2021—79 pages.
*Samsung Electronics Co., Ltd.*, v. *Lynk Labs, Inc.* U.S. Pat. No. 10,750,583, Power of Attorney for Petitioner Samsung Electronics Co., Ltd.,—3 pages.
*Samsung Electronics Co., Ltd.*, v. *Lynk Labs, Inc.* U.S. Pat. No. 10,750,583, Petitioner's Notice Regarding Multiple Petitions—8 pages.
*Samsung Electronics Co., Ltd.*, v. *Lynk Labs, Inc.* Case: IPR2022-00100, U.S. Pat. No. 10,750,583, Patent Owner's Mandatory Notices Pursuant to 37 C.F.R Section 42.8—5 pages.
*Samsung Electronics Co., Ltd.*, v. *Lynk Labs, Inc.* U.S. Pat. No. 10,750,583, Declaration of R. Jacob Baker, PH.D., P.E. In Support of Petition for Inter Partes Review of U.S. Pat. No. 10,750,583 Ex. 1002.
Baker CV, 37 pages—Ex. 1003.
U.S. Appl. No. 16/449,273, filed Jun. 21, 2019 Ex. 1004.
Sedra/Smith, "Microelectronic Circuits," Fourth Edition, Parts 1-4, pp.—Exs. 1041, 1061, 1054, 1034.
Watson Mastering Electronics, Third Edition, pp. 1-151—Exs. 1012, 1018, 1031.
Tim Williams, The Circuit Designer's Companion, First Published 1991, ISBN 0 7506 1142 1, 314 pages—Ex. 1042, 1094.
Chamber Dictionary of Science and Technology, General Edition Professor Peter MB Walker, CBE, FRSE, Chambers Harrap Publsihed Ltd. 1999 ISBN 0 550 14110 3, 4 pages—Ex. 1047, 1024.

(56) References Cited

OTHER PUBLICATIONS

McGraw-Hill Dictionary of Scientific and Technical Terms, Sixth Edition, Library of Congress Cataloging in Publication Data , ISBN 0-07-042313-X, pp. 4—Ex. 1048, 1018.
U.S. Appl. No. 61/284,927, filed Dec. 28, 2009 Ex. 1064.
U.S. Appl. No. 61/335,069, filed Dec. 31, 2009 Ex. 1065.
U.S. Appl. No. 61/215,144, filed May 1, 2009 Ex. 1070.
"Supplemental Report of Parties' Planning Meeting", from *Samsung Electronics Co. Ltd et al* v. *Lynk Labs, Inc.*, Case No. 1:21-cv-02665, filed Oct. 14, 2021—11 pages Ex. 1075, Ex. 1080.
Docket from *Samsung Electronics Co. Ltd. et al* v. *Lynk Labs, Inc.*, Case No. 1:21-cv-02665 printed Oct. 25, 2021—14 pages Ex. 1076.
Estimated Patent Case Schedule in Northern Distric of Illinois—2 pages Ex. 1079.
"Defendant Lynk Labs, Inc.'s Answer to Plaintiffs Samsung Electronics Co., Ltd. and Samsung Electronics America, Inc.'s First Amended Complaint and Counterclaims" from *Samsung Electronics Co. Ltd. et al* v. *Lynk Labs, Inc.*, Case No. 1:21-cv-02665, filed Aug. 3, 2021—67 pages Ex. 1082.
"Defendant Lynk Labs, Inc.'s Amended Preliminary Infringement Contentions" from *Samsung Electronics Co. Ltd. et al* v. *Lynk Labs, Inc.*, Case No 1:21-cv-02665, filed Aug. 31, 2021—9 pages Ex. 1083.
U.S. Pat. No. 10,750,583 Exemplary Infringement Chart Samsung SmartThings Hub (as Appendix J-2)—11 pages Ex. 1084.
"Notification of Docket Entry" from *Samsung Electronics Co. Ltd. et al* v. *Lynk Labs, Inc.*, Case No. 1:21-cv-02665, filed Jul. 27, 2021—1 page Ex. 1085.
"Order" as scheduling order from *Samsung Electronics Co. Ltd. et al* v. *Lynk Labs, Inc.*, Case No. 1:21-cv-02665, filed Aug. 19, 2021—2 pages Ex. 1086.
"Notification of Docket Entry" from *Samsung Electronics Co. Ltd. et al* v. *Lynk Labs, Inc.*, Case No. 1:21-cv-02665, filed Oct. 18, 2021—1 page Ex. 1087.
Defendant Lynk Labs, Inc.'s Supplement to Second Amended Preliminary Infringement Contentions ('551 Patent and 979 Patent) dated Sep. 22, 2021 30 pages—Ex. 1072.
*Samsung Electronics Co., Ltd.* v. *Lynk Labs, Inc.* U.S. Pat. No. 10,517,149 Petition for Inter Partes Review of U.S. Pat. No. 10,517,149, 98 pages.
*Samsung Electronics Co., Ltd.* v. *Lynk Labs, Inc.* U.S. Pat. No. 10,517,149 Power of Attorney for Petitioner Samsung Electronics Co., Ltd. 3 pages.
*Samsung Electronics Co., Ltd. et al.* v. *Lynk Labs, Inc.* Case IPR2022-0098, U.S. Pat. No. 10,4517,149 Notice of Filing Date Accorded to Petition, dated Nov. 23, 2021, 6 pages.
*Samsung Electronics Co., Ltd.* v. *Lynk Labs, Inc.* Case: IPR2022-0098, U.S. Pat. No. 10,517,149 Patent Owner's Mandatory Notices Pursuant to 37 C.F.R. Secion 42.8, 5 pages.
*Samsung Electronics Co., Ltd.* v. *Lynk Labs, Inc.*, U.S. Pat. No. 10,517,149 Declaration of R. Jacob Baker, Ph.D., P.E. In Support of Petition for Inter Partes Review of U.S. Pat. No. 10,517,149, 179 pages—Ex. 1002.
R. Jacob (Jake) Baker, Ph.D., P.E. CV, 37 pages—Ex. 1003.
File History of U.S. Pat. No. 10,517,149, 359 pages—Ex. 1004.
Watson Mastering Electronics, Third Edition, pp. 1-151—Ex. 1018.
PCT File History US/2010/62235, filed Dec. 28, 2010—Ex. 1039.
PCT File History US/2010/001597, filed May 28, 2010—Ex. 1043.
PCT File History US/2010/001269, filed Apr. 30, 2010—Ex. 1044.
U.S. Appl. No. 61/333,963, filed May 12, 2010—Ex. 1046.
U.S. Appl. No. 61/284,927, filed Dec. 28, 2009—Ex. 1047.
U.S. Appl. No. 60/335,963, filed Dec. 31, 2009—Ex. 1048.
U.S. Appl. No. 60/997,771, filed Oct. 6, 2007—Ex. 1049.
U.S. Appl. No. 60/547,653, filed Feb. 25, 2004—Ex. 1050.
U.S. Appl. No. 60/559,867, filed Feb. 25, 2004—Ex. 1051.
U.S. Appl. No. 61/217,215, filed May 28, 2009—Ex. 1052.
U.S. Appl. No. 61/215,144, filed May 1, 2009—Ex. 1053.
Civil Docket for Case#6:21-cv-02665, Northern District of Illinois, Samsung Electronics. Co., Ltd., filed May 17, 2021, 14 pages—Ex. 1061.
US District Court for the Northern District of Illinois, Estimated Patent Case Schedule, 2 pages—Ex. 1062.
*Samsung Electronics Co., Ltd. and Samsung Electronics America, Inc.*, v. *Lynk Labs, Inc.*, Case No. 1:21-cv-02665—Defendant Lynk Labs, Inc.'s Amended Preliminary Infringement Contentions, Aug. 31, 2021 9 pages—Ex. 1066.
Sedra/Smith, "Microelectronic Circuits," Fourth Edition, Part 1 of 4, pp. 1-161—Ex. 1041, Ex. 1061, Ex. 1054.
Sedra/Smith, "Microelectronic Circuits," Fourth Edition, Part 2 of 4, pp. 162-1048 pages—Ex. 1041, Ex. 1061, Ex. 1054.
Sedra/Smih, "Microelectronic Circuits," Fourth Edition, Part 3 of 4, pp. 1049-1230 pages—Ex. 1041, Ex. 1061, Ex. 1054.
Sedra/Smith, "Microelectronic Circuits," Fourth Edition, Part 4 of 4, pp. 1231-1237 pages—Ex. 1041, Ex. 1061, Ex. 1054.
*Samsung Electronics Co., Ltd. and Samsung Electronics America, Inc.*, v. *Lynk Labs, Inc.*, Case No. 1:21-cv-02665—Defendant Lynk Labs, Inc.'s Amended Preliminary Infringement Contentions, 9 pages—Ex. 1066.
U.S. Pat. No. 10,517,149 ("the '149 Patent") Exemplary Infringement Contention Claim Charts, Appendix A-5 through I-3—Ex. 1067.
*Samsung Electronics Co., Ltd. et al.* v. *Lynk Labs, Inc.* Case No. 1:21-cv-02665, Notification of Docket Entry Jul. 27, 2021, 1 page—Ex. 1068.
*Samsung Electronics Co., Ltd. et al.* v. *Lynk Labs, Inc.* Case No. 1:21-cv-02665, Scheduling Order dated Aug. 19, 2021, 2 pages—Ex. 1069.
Civil Docket for Case #6:21-cv-00097-ADA, Western District of Texas (Waco)—Lynk Labs, Inc. filed Jan. 29, 2001, 9 pages—Ex 1074.
*Samsung Electronics Co., Ltd. et al.* v. *Lynk Labs, Labs, Inc.* Case No. 1:21-cv-02665, Notification of Docket Entry Oct. 18, 2021, 1 page—Ex. 1070.
*Samsung Electronics Co., Ltd. and Samsung Electronics America, Inc.*, v. *Lynk Labs, Inc.*, Case No. 1:21-cv-02665—Defendant Lynk Labs, Inc's Answer to Plaintiffs Samsung Electronics Co., Ltd. and Samsung Electronics America, Inc.'s First Amended Complaint and Counterclaims, filed Aug. 3, 2021, 67 pages—Ex. 1071.
*Lynk Labs, Inc.*, v. *Home Dept USA, Inc., The Home Depot Inc., and Home Depot Product Authority, LLC*, Case. No. 6:21-cv-00097, Complaint for Patent Infringement dated Jan. 29, 2021, 88 page—Ex. 1072.
*Lynk Labs, Inc.*, v. *Home Dept USA, Inc., The Home Depot Inc., and Home Depot Product Authority, LLC*, Case No. 6:21-cv-00097-ADA, First Amended Complaint for Patent Infringement dated Mar. 17, 2021, 94 pages—Ex. 1073.
*Samsung Electronics Co., Ltd. and Samsung Electronics America, Inc.*, v. *Lynk Labs, Inc.* Case No. 1:21-cv-02665—Supplemental Report of Parties' Planning Meeting, filed Oct. 14, 2021, 11 pages—ex. 1075.
Tim Williams, The Circuit Designer's Companion, First Published 1991, ISBN 0 7506 1142 1, 314 pages—Ex. 1094.
*Lynk Labs, Inc.*, v. *Home Depot USA, Inc. The Home Dept Inc., and Home Depot Product Authority, LLC*, Case No. 6:21-cv-00097-ADA, Home Depot's Preliminary Invalidity Contentions and Additional Disclosure Pursuant to Scheduling Order dated Aug. 18, 2021—22 pages.
U.S. Pat. No. 10,492,251 (251 Patent)—Exhibit A-01—Takeo '301.
U.S. Pat. No. 10,492,251 (251 Patent)—Exhibit A-02—Lynam '623.
U.S. Pat. No. 10,492,251 (251 Patent)—Exhibit A-03—Filipovsky '319.
U.S. Pat. No. 10,492,251 (251 Patent)—Exhibit A-04 Deese '719.
U.S. Pat. No. 10,492,251 (251 Patent)—Exhibit A-05 Okuno.
U.S. Pat. No. 10,492,251 (251 Patent)—Exhibit A-06—Ohishi '319.
U.S. Pat. No. 10,492,251 (251 Patent)—Exhibit A-07 Teshima.
U.S. Pat. No. 10,349,479 ("'479 Patent")—Exhibit B-01 Dowling.
U.S. Pat. No. 10,349,479 ("'479 Patent")—B-02 Ter Weeme.
U.S. Pat. No. 10,349,479 ("'479 Patent")—Exhibit B-03 Lin.
U.S. Pat. No. 10,349,479 ("'479 Patent")—Exhibit B-04 Lys '483.
U.S. Pat. No. 10,349,479 ("'479 Patent")—Exhibit B-05 Leong '814.

(56) References Cited

OTHER PUBLICATIONS

U.S. Pat. No. 10,349,479 ("'479 Patent")—Exhibit B-06 Calon.
U.S. Pat. No. 10,349,479 ("'479 Patent")—Exhibit B-07 Nakagawara.
U.S. Pat. No. 10,757,783 ("'783 Patent")—Exhibit C-01 Grajcar.
U.S. Pat. No. 10,757,783 ("'783 Patent")—Exhibit C-02 Reymond.
U.S. Pat. No. 10,757,783 ("'783")—Exhibit C-03 Walter.
U.S. Pat. No. 10,757,783 ("'783 Patent")—Exhibit C-04 Lyos '901.
U.S. Pat. No. 10,757,783 ("'783 Patent")—Exhibit C-05 Hair.
U.S. Pat. No. 10,757,783 ("'783 Patent")—Exhibit C-06 Cho.
U.S. Pat. No. 10,757,783 ("'783 Patent")—Exhibit C-07 Coleman.
U.S. Pat. No. 10,757,783 ("'783 Patent")—Exhibit C-08 Shimizu.
U.S. Pat. No. 10,154,551 ("'551 Patent")—Exhibit D-01 Saito.
U.S. Pat. No. 10,154,551 ("'551 Patent")—Exhibit D-02 Hochstein '168.
U.S. Pat. No. 10,154,551 ("'551 Patent")—Exhibit D-03 Reymond.
U.S. Pat. No. 10,154,551 ("'551 Patent")—Exhibit D-04 Panagotacos.
U.S. Pat. No. 10,154,551 ("'551 Patent")—Exhibit D-05 Liu.
U.S. Pat. No. 10,154,551 ("''551 Patent")—Exhibit D-06 Deese 450.
U.S. Pat. No. 10,154,551 ("'551 Patent")—Exhibit D-07 Lys.
U.S. Pat. No. 10,154,551 ("'551 Patent")—Exhibit D-08 Shimizu.
U.S. Pat. No. 10,517,149 ("'149 Patent")—Exhibit E-01 Takahashi.
U.S. Pat. No. 10,517,149 ("'149 Patent")—Exhibit E-02 Saito '590.
U.S. Pat. No. 10,517,149 ("'149 Patent")—Exhibit E-03 Lys '399.
U.S. Pat. No. 10,517,149 ("'149 Patent")—Exhibit E-04 Catalano '081.
U.S. Pat. No. 10,517,149 ("'149 Patent")—Exhibit e-05 Deese '719.
U.S. Pat. No. 10,652,979 ("'979 Patent")—Exhibit F-01 Coats '555.
U.S. Pat. No. 10,652,979 ("'979 Patent")—Exhibit F-02 Birrell '406.
U.S. Pat. No. 10,652,979 ("'979 Patent")—Exhibit F-03 Muthu '159.
U.S. Pat. No. 10,652,979 ("'979")—Exhibit F-04 Teshima '408.
U.S. Pat. No. 10,652,979 ("'979 Patent")—Exhibit F-05 Takeo.
U.S. Pat. No. 10,652,979 ("'979 Patent")—Exhibit F-06 Deese '719.
U.S. Appl. No. 60/839,453, filed Aug. 23, 2006, enttitle "Lighting Device and Lighting Method" to Van de Ven and Negley, ("453 Provisional ").
U.S. Appl. No. 60/793,524, filed Apr. 20, 2006, entitled "Lighting Device and Lighting Method" to Van de Ven and Negley, ("524 Provisional").
U.S. Appl. No. 60/844,325, filed Sep. 13, 2006, entitled "Boost/FlyBack Power Supply Topology With Low Side MOSFET Current Control" to Myers ("Myers").
Interim LED Purchase Specification of the Institute of Transportation Engineers, Jul. 1998 ("1998 Specification").
"Comparison of Control Option in Private Office in an Advanced Lighting Controls Testbed," by Judith D. Jennings et al., and published in Apr. 1999 ("Jennings").
Vehicle Detection Using a Magetic Field Sensor, by Stanely V. Marshall, and published in May 1978 ("Marshall").
*Home Depot U.S.A., Inc.* v. *Lynk Labs, Inc.* Case IPR 2022-0023 U.S. Pat. No. 10,517,149, dated Dec. 24, 2019, Declaration of Dr. Lebby dated Oct. 20, 2021, 157 pages—Ex. 1002.
*Lynk Labs, Inc.*, v. *Home Depot USA, Inc., The Home Dept Inc., and Home Depot Product Authority, LLC* Case No. 6:21-cv-00097-ADA Scheduling Order filed Aug. 13, 2021, 4 pages—Ex. 1003.
*Lynks Labs, Inc.*, v. *Home Depot USA, Inc., The Home Dept Inc., and Home Depot Product Authority, LLC* Case No. 6:21-cv-00097 Complaint for Patent Infringement dated Jan. 29, 2021, 88 pages—Ex. 1004.
*Lynk Labs, Inc.* v. *Home Depot USA, Inc., The Home Dept Inc., and Home Depot Product Authority, LLC* Case No. 6:21-cv-00097-ADA Plaintiff Lynk Labs, Inc,'s Amended Preliminary Infringement Contentions '149 Patent dated Jun. 23, 2021, 154 pages—Ex. 1005.
U.S. Appl. No. 16/215,502, filed Dec. 10, 2018, 359 pages—Ex. 1006.
IEEE 100 The Authoritative Dictionary of IEEE Standards Terms, Seventh Edition, Published by Standards Information Network IEEE Press, pp. 1-4—Ex. 1007.
*Lynk Labs, Inc.* v. *Home Depot USA, Inc., The Home Dept Inc., and Home Depot Product Authority, LLC* Case No. 6:21-cv-00097-ADA Defendants'Opening Claim Construction Brief on the Terms of U.S. Pat. Nos. 10,091,842, 10,154,551, 10,349,479, 10,492,251, 10,517,149, 10,537,001, 10,652,979, 10,757,783 and 10,932,341 filed Oct. 6, 2021, 38 pages—Ex. 1015.
U.S. Appl. No. 16/274,164, filed Feb. 12, 2019, 543 pages—Ex. 1016.
Heat Sink, Merriam-Webster; Examples of heat sink in a sentence, http://wwwmerriam-webster.com/dictionary/heat%20sink, 7 pages—Ex. 1017.
Insulator, Britannica Online Encylopedia Full Article, https://www.britannica.com/print/article/289459, 2 pages—Ex. 1018.
*Home Depot USA, Inc.*, v. *Lynk Labs, Inc.* Case IPR2022-00023 U.S. Pat. 10,517,149 dated Dec. 24, 2019, Petition for Inter Partes Review dated Oct. 20, 2021, 74 pages.
*Home Depot USA, Inc.*, v. *Lynk Labs, Inc.* Case IPR2022-00023 U.S. Pat. No. 10,517,149 dated Dec. 24, 2019, Petitioner's Power of Attorney dated Oct. 20, 2021, 2 pages.
*Home Depot USA, Inc.*, v. *Lynk Labs, Inc.* Case IPR2022-00023 U.S. Pat. No. 10,517,149 dated Dec. 24, 2019, Patent Owner's Mandatory Notices Pursuant to 37 C.F.R. Section 42.8 dated Nov. 10, 2021, 5 pages.
U.S. Pat. No. 10,966,298 (298 Patent)—Exhibit H-06—Mac Powerbrook G3.
U.S. Pat. No. 10,966,298 (298 Patent)—Exhibit H-07—iPod G3.
U.S. Pat. No. 10,966,298 (298 Patent)—Exhibit H-08—iPAQ H5500.
U.S. Pat. No. 11,019,697 (697 Patent)—Exhibit I-01—Piepgrass.
U.S. Pat. No. 11,019,697 (697 Patent)—Exhibit I-02—Hitachi.
U.S. Pat. No. 11,019,697 (697 Patent)—Exhibit I-03—Mueller.
U.S. Pat. No. 11,019,697 (697 Patent)—Exhibit I-04—NEC.
U.S. Pat. No. 11,019,697 (697 Patent)—Exhibit I-05—Miskin '299.
U.S. Pat. No. 11,019,697 (697 Patent)—Exhibit I-06—Mac Powerbook G3.
U.S. Pat. No. 11,019,697 (697 Patent)—Exhibit I-07—iPod G3.
U.S. Pat. No. 11,019,697 (697 Patent)—Exhibit I-08—iPAQ H5500.
Macintosh PowerBook G3, 1999.
Apple iPod Third Generation User's Guide, released Apr. 29, 2003.
"HP iPAQ Pocket PC H5500," GadgetSpeak, published Nov. 6, 2003.
Light-Emitting Diodes by E. Fred Schubert, published in 2003 ("Schubert").
Fundamentals of LED Drivers by A. Hernandez et al., published in 2003 ("Hernandez").
Color System by Kinetics iColor MR Data Sheet.
WDS Wireless Dimming Systems Operator's Manual published in 2003 ("WDS-Manual").
AND8137/D—High Current LED—Isolated Low Voltage AC Drive—Application Note by Carl Walding, published in Oct. 2003 ("AND8137/D").
Characteristics of high-efficient InGaN-based white LED lighting by Yuji Uchida, published in 2011 ("Uchida").
*Home Depot U.S.A., Inc.*, v. *Lynk Labs, Inc.*, U.S. Pat. No. 10,932,341, filed Jan. 10, 2020, dated Feb. 23, 2021—PGR2002-00009; Declaration of Dr. Dean Neikirk U.S. Pat. No. 10,932,341, 140 pages—Ex. 1002.
*Home Depot U.S.A., Inc.*, v. *Lynk Labs, Inc.*, U.S. Pat. No. 10,932,341, filed Jan. 10, 2020, dated Feb. 23, 2021—PGR2022-00009: Petition for Post Grant Review of U.S. Pat. No. 10,932,341, 94 pages.
U.S. Appl. No. 16/740,295, filed Jan. 10, 2020 (Part 1) 768 pages—Ex. 1003.
U.S. Appl. No. 16/740,295, filed Jan. 10, 2020 (Part 2) 466 pages—Ex. 1003.
*Lynk Labs, Inc.*, v. *Home Depot USA, Inc., The Home Depot Inc., and Home Depot Product Authority, LLC*, Case No. 6:21-cv-00097, Complaint for Patent Infringement dated Jan. 29, 2021—Ex. 1011.
*Lynk Labs, Inc.*, v. *Home Depot USA, Inc., The Home Depot Inc., and Home Depot Product Authority, LLC*, Case No. 6:21-cv-00097-ADA, Plaintiff Lynk Labs, Inc.'s Amended Preliminary Infringement Contentions, dated Jun. 23, 2021, 241 pages—Ex. 1012.

(56) References Cited

OTHER PUBLICATIONS

*Lynk Labs, Inc.*, v. *Home Depot USA, Inc., The Home Depot Inc., and Home Depot Product Authority, LLC*, Case No. 6:21-cv-00097-ADA, Scheduling Order filed Aug. 13, 2021, 4 pages—Ex. 1013.
U.S. Appl. No. 61/217,215, filed May 28, 2009, 32 pages—Ex. 1014.
U.S. Appl. No. 60/997,771, filed Oct. 6, 2007, 24 pages—Ex. 1015.
*Lynk Labs, Inc.*, v. *Home Depot USA, Inc., The Home Depot Inc., and Home Depot Product Authority, LLC*, Case No. 6:21-cv-00097-ADA, Defendants' Opening Claim Construction Brief on the Terms on U.S. Pat. Nos. 10,091,842, 10,154,551, 10,349,479, 10,492,251, 10,517,149, 10,537,001, 10,652,979, 10,757,783, and 10,932,341 filed Oct. 6, 2021, 38 pages—Ex. 1021.
*Lynk Labs, Inc.*, v. *Home Depot USA, Inc., The Home Depot Inc., and Home Depot Product Authority, LLC*, Case No. 6:21-cv-00097-ADA, Plaintiff Lynk Labs, Inc.'s Responsive Claim Construction Brief filed Oct. 27, 2021, 47 pages—Ex. 1022.
Application Multi-Voltage and Multi-Brightness LED Lighting Devices and Methods of Using Same, Remarks filed Jun. 13, 2019 12 pages—Ex. 1023.
U.S. Appl. No. 15/369,218 Non-Final Office Action dated Oct. 2, 2018—Ex. 1024.
Response to Office Action U.S. Appl. No. 16/440,884, filed Aug. 22, 2019, 11 pages—Ex. 1026.
IEEE 100 The Authoritative Dictionary of IEEE Standards Terms Seventh Edition, Published by Standards Information Network IEEE Press, 3 pages—Ex. 1028.
Response to Office Action U.S. Appl. No. 16/440,884, filed Jun. 16, 2020, 8 pages—Ex. 1029.
*Home Depot USA, Inc.*, v. *Lynk Labs, Inc.*, Case PGR2002-00009, U.S. Pat. No. 10,932,341, Patent Owner's Mandatory Notices Pursuant to 37 C.F.R. Section 42.8 dated Nov. 19, 2021, 5 pages.
*Home Depot USA, Inc.*, v. *Lynk Labs, Inc.*, Case PGR2022-00009, U.S. Pat. No. 10,932,341, dated Feb. 23, 2021, Petitioner's Power of Attorney dated Nov. 5, 2021, 2 pages.
*Home Depot U.S.A., Inc.*, v. *Lynk Labs, Inc.*, U.S. Pat. No. 10,932,141, filed Jan. 10, 2020, dated Feb. 23, 2021, IPR 2022-00143, Petition for Inter Partes Review of U.S. Pat. No. 10,932,341 dated Nov. 24, 2021, 81 pages.
U.S. Appl. No. 61/333,963, filed May 12, 2010, 52 pages—IPR2021-01299 Ex 1036; IPR2021-10347 Ex 1055' IPR2021-01346 Ex 1036, IPR2021-01345 Ex 1037; IPR2021-01300 Ex 1036.
U.S. Appl. No. 61/284,927, filed Dec. 28, 2009, 54 pages—IPR2021-01299 Ex 1037; IPR2021-10347 Ex 1056; IPR2021-01346 Ex 1037, IPR2021-01345 Ex 1037; IPR2021-01300 Ex. 1037.
U.S. Appl. No. 61/335,069, filed Dec. 31, 2009, 65 pages—IPR2021-01299 Ex 1038; IPR2021-10347 Ex 1057; IPR2021-01346 Ex 1038, IPR2021-01345 Ex 1038, IPR2021-01300 Ex 1038.
U.S. Appl. No. 60/997,771, filed Oct. 6, 2007, 26 pages—IPR2021-01299 Ex 1039; IPR2021-10347 Ex 1058; IPR2021-01346 Ex 1039, IPR2021-01345 Ex. 1039; IPR2021-01300 Ex 1039.
U.S. Appl. No. 60/547,653, filed Feb. 25, 2004, 84 pages—IPR2021-01299 Ex 1040; IPR2021-10347 Ex 1059; IPR2021-01346 Ex. 1040, IPR2021-01345 Ex 1040; IPR2021-01300 Ex 1040.
U.S. Appl. No. 60/559,867, filed Feb. 25, 2004, 90 pages—IPR2021-01299 Ex 1041; IPR2021-10347 Ex 1060; IPR2021-01346 Ex. 1041, IPR2021-01345 Ex 1041; IPR2021-01300 Ex 1041.
U.S. Appl. No. 61/217,215, filed May 28, 2008, 47 pages—IRP2021-01299 Ex 1042; IPR2021-10347 Ex 1061; IPR2021-01346 Ex 1042, IPR2021-01345 Ex 1042; IPR2021-01300 Ex 1042.
U.S Appl. No. 61/215,144, filed May 1, 2009, 11 pages—IPR2021-01299 Ex 1043; IPR2021-10347 Ex 1062; IPR2021-01346 Ex 1043, IPR2021-01345 Ex 1043; IPR201-01300 Ex 1043.
Watson, John, Mastering Electronics, Third Ed., McGraw Hill Inc., published in 1990—IRP2021-01299 Ex 1080: IPR201-10347 Ex 1026; IPR2021-01346 Ex 1062; IPR2021-01345 Ex 1060; IPR 2021-01300 Ex 1006.
Sedra, A., et al., Microelectronic Circuits, Fourth Ed., Oxford University Press, published in 1998—IPR2021-01299 Ex 1081; IPR2021-10347 Ex 1027; IPR2021-01346 Ex 1063; IPR2021-01345 Ex 1061 (4 parts): IRP2021-01300 Ex 1007.
Compaq Comp. Corp. et al., Universal Serial Bus Specification Revision 2.0 published in 2000, 650 pages—IPR2021-01299 Ex 1091; IPR2021-10347 Ex 1095; IPR2021-01346 Ex 1069; IPR2021-01345 Ex 1072; IPR2021-01300 Ex 1055.
Declaration of R. Jacob Baker. Ph.D., P.E. U.S. Pat. No. 10,966,298, Inter Partes Review No. IRP2021-01347, 152 pages—Ex 1002.
Gilbisco, Stan, Handbook of Radio & Wireless Technology, published in 1999, 188 pages, McGraw-Hill—IPR2012-10347 Ex 1013.
Petition for Inter Partes Review, *Samsung Electronics Co., Ltd.*, Petitioner, v. *Lynk Labs, Inc.*, Patent Owner, Case IPR201-01347 U.S. Pat. No. 10,966,298, dated Dec. 3, 2019, Title: "AC Light Emitting Diode and AC LED Drive Methods and Apparatus," 70 pages dated Sep. 7, 2021.
Petition for Inter Partes Review, *Samsung Electronics Co., Ltd.*, Petitioner, v. *Lynk Labs, Inc.*, Patent Owner, Case IPR2021-01346 U.S. Pat. No. 10,499,466, dated Dec. 10, 2019, Title: "AC Light Emitting Diode and AC LED Drive Methods and Apparatus," 70 pages dated Sep. 7, 2021.
Petition for Inter Partes Review, *Samsung Electronics Co., Ltd.*, Petitioner, v. *Lynk Labs, Inc.*, Patent Owner, Case IPR2021-01345 U.S. Pat. No. 10,492,252, dated Nov. 26, 2019, Title: "AC Light Emitting Diode and AC LED Drive Methods and Apparatus," 65 pages dated Sep. 7, 2021.
Petition for Inter Partes Review, *Samsung Electronics Co., Ltd.*, Petitioner, v. *Lynk Labs, Inc.*, Patent Owner, Case IPR2021-01300 U.S. Pat. No. 11,019,697, dated May 25, 2019, Title: "AC Light Emittting Diode and AC LED Drive Methods and Apparatus," 71 pages dated Sep. 7, 2021.
Petition for Inter Partes Review, *Samsung Electronics Co., Ltd.*, Petitioner, v. *Lynk Labs, Inc.*, Patent Owner, Case IPR2021-01299 U.S. Pat. No. 10,506,674, dated Dec. 10, 2019, Title: "AC Light Emitting Diode and AC LED Drive Methods and Apparatus," 70 pages dated Sep. 7, 2021.
Plaintiff's First Amended Complaint for Patent Infringement, Case No. 6:21-cv-00526-ADA, *Lynk Labs, Inc.* v. *Samsung ElectronicsCo., Ltd. and Samsung Electronics America, Inc.* dated Jun. 9, 2021, 18 pages—IPR2021-01346 Ex 1080, IPR2021-01345 Ex 1056; IPR2021-01300 Ex 1086.
Defendant'Preliminary Infringement Contentions, Case No. 1:21-cv-2655, *Samsung Electronics Co., Ltd. and Samsung Electronics America, Inc.* v. *Lynk Labs, Inc.*, dated Jul. 21, 2021, 9 pages—IPR2012-01346 Ex 1081, IPR2021-01345 Ex 1057, IPR2021-01300 Ex 1080.
Defendant's Answer and Counterclaims, Case No. 1:21-cv-2665, *Samsung Electronics Co., Ltd. and Samsung Electronics America, Inc.* v. *Lynk Labs, Inc.*, dated Aug. 3, 2021, 67 pages—IPR2021-01346 Ex 1083, IPR2021-01345 Ex 1077, IPR2021-01300 Ex 1082.
Defendant's Amended Preliminary Infringement Contentions, Case No. 1:21-cv-2665, *Samsung Electronics Co., Ltd. and Samsung Electronics America, Inc.* v. *Lynk Labs, Inc.*, dated Aug. 31, 2021, 9 pages—IPR2021-01346 Ex 1086; IPR2021-01345 Ex 1086; IPR2021-01300 Ex 1087.
Scheduling Order, Case No. 1:21-cv-2665, *Samsung Electronics Co., Ltd. and Samsung Electronics America, Inc.* v. *Lynk Labs, Inc.*, dated Aug. 19, 2021—IPR2021-01346 Ex 1085, IPR2021-01345 Ex 1085, IPR2021-01300 Ex 1084.
Notification of Docket Entry, Case No. 1:21-cv-2665, *Samsung Electronics Co., Ltd. and Samsung Electronics America, Inc.* v. *Lynk Labs, Inc.*, dated Jul. 27, 2021, 1 pages—IPR2021-01346 Ex 1084, IPR2021-01345 Ex 1084, IPR2021-01300 Ex 1083.
Declaration of R. Jacob Baker. Ph.D., P.E. U.S. Pat. No. 10,499,466, 187 pages, Inter Partes Review No. IPR2021-01346—Ex 1002.
Declaration of R. Jacob Baker. Ph.D., P.E. U.S. Pat. No. 10,492,252, 148 pages, Inter Partes Review No. IPR2021-01345—Ex 1002.
Declaration of R. Jacob Baker. Ph.D., P.E. U.S. Pat. No. 11,019,697, 261 pages, Inter Partes Review No. IPR2021-01300—Ex 1002.
Declaration of R. Jacob Baker. Ph.D., P.E. U.S. Pat. No. 10,506,674, 172 pages, Inter Partes Review No. IPR2021-01299—Ex 1002.
Declaration of R. Jacob Baker. Ph.D., P.E. U.S. Pat. No. 10,999,298, 152 pages, Inter Partes Review No. IPR2021-01347—Ex. 1002.

(56) References Cited

OTHER PUBLICATIONS

Plaintiff'Complaint, Case No. 1:21-cv-2665, *Lynk Labs, Inc.* v. *Samsung Electronics Co. Ltd. and Samsung Electronics America, Inc.*, dated May 25, 2021, 12 pages—IPR2021-01300 Ex 1074.
Plaintiff's First Amended Complaint, Case No. 1:21-cv-2665, *Samsung Electronics Co., Ltd. and Samsung Electronics America, Inc.* v. *Lynk Labs, Inc.*, dated May 25, 2021, 33 pages—IPR2021-01300 Ex 1075.
Plaintiff'Complaint, Case No. 1:21-cv-2665, *Samsung Electronics Co., Ltd. and Samsung Electronics America, Inc.* v. *Lynk Labs, Inc.*, dated May 17, 2021, 30 pages—IPR2021-01300 Ex 1076.
The Microarchitecture of the Pentium 4 Processor by Hinton et al., published in 2001, 13 pages—IPR2021-01300 Ex 1017.
Wireless Medium Access Control (MAC) and Physical Layer (PHY) Specifications for Wireless Personal Area Networks (WPANs) by IEEE Computer Society, 1018 IEEE 812.15.1, published in 2002, 1165 pages—IPR2021-01300 Ex 1018.
*Samsung Electronics Co., Ltd.*, v. *Lynk Labs, Inc.* Patent Owner—Power of Attorney for Petitioner Samsung Electronics Co., Ltd. U.S. Pat. No. 10,492,252, dated Jul. 21, 2021—3 pages.
*Samsung Electronics Co., Ltd.*, v. *Lynk Labs, Inc.*, Case IPR2021-01345, U.S. Pat. No. 10,492,252—Notice of Filing Date Accorded to Petition and Time for Filing Patent Owner Preliminary Response filed Sep. 7, 2021—5 pages.
*Samsung Electronics Co., Ltd.*, v. *Lynk Labs, Inc.*, Case IPR2021-01345, U.S. Pat. No. 10,492,252—Patent Owner's Mandatory Notices Pursuant to 37 C.F.R. Section 42.8—dated Sep. 28, 2021—5 pages.
*Samsung Electronics Co., Ltd.*, v. *Lynk Labs, Inc.* Patent Owner—Power of Attorney for Petitioner Samsung Electronics Co., Ltd. U.S. Pat. No. 10,966,298 dated Jul. 21, 2021—3 pages.
*Samsung Electronics Co., Ltd.*, v. *Lynk Labs, Inc.*, Case IPR2021-01347, U.S. Pat. No. 10,966,298—Notice of Filing Date Accorded to Petition and Time for Filing Patent Owener Preliminary Response filed Sep. 7, 2021—5 pages.
*Samsung Electronics Co., Ltd.*, v. *Lynk Labs, Inc.*, Case IPR2021-01347, U.S. Pat. No. 10,966,298—Patent Owner's Mandatory Notices Pursuant to 37 C.F.R. Section 42.8—dated Sep. 28, 2021—5 pages.
*Samsung Electronics Co., Ltd.*, v. *Lynk Labs, Inc.* Patent Owner—Power of Attorney for Petitioner Samsung Electronics Co., Ltd. U.S. Pat. No. 10,499,466 dated Jul. 21, 2021—3 pages.
*Samsung Electronics Co., Ltd.*, v. *Lynk Labs, Inc.*, Case IPR2021-01346, U.S. Pat. No. 10,499,466—Notice of Filing Date Accorded to Petition and Time for Filing Patent Owner Preliminary Response filed Sep. 7, 2021—5 pages.
*Samsung Electronics Co., Ltd.*, v. *Lynk Labs, Inc.*, Case IPR2021-01346 , U.S. Pat. No. 10,499,466—Patent Owner's Mandatory Notices Pursuant to 37 C.F.R. Section 42.8—dated Sep. 28, 2021—5 pages.
*Samsung Electronics Co., Ltd.*, v. *Lynk Labs, Inc.* Patent Owner—Power of Attorney for Petitioner Samsung Electronics Co., Ltd. U.S. Pat. No. 11,019,697 dated Jul. 21, 2021—3 pages.
*Samsung Electronics Co., Ltd.*, v. *Lynk Labs, Inc.*, Case IPR2021-01300, U.S. Pat. No. 11,019,697—Notice of Filing Date Accorded to Petition and Time for Filing Patent Owner Preliminary Response filed Sep. 7, 2021—6 pages.
*Samsung Electronics Co., Ltd.*, v. *Lynk Labs, Inc.*, Case IPR2021-01300, U.S. Pat. No. 11,019,697—Patent Owner's Mandatory Notices Pursuant to 37 C.F.R. Section 42.8—dated Sep. 28, 2021—5 pages.
*Samsung Electronics Co., Ltd.*, v. *Lynk Labs, Inc.*, Case IPR2021-01300, U.S. Pat. No. 11,019,697—Petitioner's Response to Notice of Filing Date Accorded to Petition and Time for Filing Patent Owner Preliminary Response (Paper No. 3) dated Sep. 20, 2021—3 pages.
*Samsung Electronics Co., Ltd.*, v. *Lynk Labs, Inc.*, IPR2021-01300, U.S. Pat. No. 11,019,697—Notice of Accepting Corrected Petition filed Sep. 20, 2021—2 pages.
*Samsung Electronics Co., Ltd.*, v. *Lynk Labs, Inc.* Patent Owner—Power of Attorney for Petitioner Samsung Electronics Co., Ltd. U.S. Pat. No. 10,506,674 dated Jul. 21, 2021—3 pages.
*Samsung Electronics Co., Ltd.*, v. *Lynk Labs, Inc.*, Case IPR2021-01299, U.S. Pat. No. 10,506,674—Notice of Filing Date Accorded to Petition and Time for Filing Patent Owner Preliminary Response filed Sep. 7, 2021—6 pages.
Petition for Inter Partes Review, *Home Depot USA, Inc.*, Petitioner, v. *Lynk Labs, Inc.*, Patent Owner, Case IPR2021-01369 U.S. Pat. 10,492,251, dated Nov. 26, 2019, Title: "AC Light Emitting Diode and AC LED Drive Methods and Apparatus," 53 pages dated Aug. 18, 2021.
Petitioner' Power of Attorney, *Home Depot USA, Inc.*, Petitioner, v. *Lynk Labs, Inc.*, Patent Owner, Case IPR2021-01369 U.S. Pat. No. 10,492,251, dated Nov. 26, 2019, Title: "AC Light Emitting Diode and AC LED Drive Methods and Apparatus," 53 pages dated Aug. 17, 2021.
Delaration of Dr. Lebby U.S. Pat. No. 10,492,251 dated Aug. 18, 2021, 134 pages—Ex 1002.
U.S. Appl. No. 16/148,945, filed Oct. 1, 2018—Ex. 1003.
Complaint for Patent Infringement, *Lynk Labs, Inc.* v. *Home Depot USA, Inc., The Home Depot Inc., and Home Depot Product Authority, LLC*, Case No. 6:21-cv-00097 dated Jan. 29, 2021, 88 pages—Ex. 1010.
Plaintiff Lynk Labs, Inc.'s Amended Preliminary Infringement Contentions, *Lynk Labs, Inc.* v. *Home Depot USA, Inc., The Home Depot Inc., and Home Depot Product Authority, LLC*, Case No. 6:21-cv-00097-ADA, dated Jun. 23, 2021, 7 pages—Ex. 1011.
Scheduling Order, *Lynk Labs, Inc.* v. *Home Depot USA, Inc., The Home Depot Inc., and Home Depot Product Authority, LLC*, Case No. 6:21-cv-00097-ADA, filed Aug. 13, 2021, 4 pages—Ex. 1012.
*Lynk Labs, Inc.* v. *Home Depot USA, Inc. The Home Depot, Inc., and Home Depot Product Authority, LLC*, Case No. 6:21-cv-00097-ADA, Defendants' Corrected Reply Claim Construction Brief on the Terms of the U.S. Pat. Nos. 10,091,842, 10,154,551, 10,349,479, 10,492,251, 10,517,149, 10,537,001, 10,652,979, 10,757,783, and 10,932,341 filed Nov. 10, 2021—60 pages.
*Lynk Labs, Inc.* v. *Home Depot USA, Inc. The Home Depot, Inc., and Home Depot Product Authority, LLC*, Case No. 6:21-cv-00097-ADA, Plaintiff Lynk Labs, Inc.'s Responsive Claim Construction Brief filed Oct. 27, 2021, Part 1.
*Lynk Labs, Inc.* v. *Home Deport USA, Inc. The Home Depot, Inc., and Home Depot Product Authority, LLC*, Case No. 6:21-cv-00097-ADA, Plaintiff Lynk Labs, Inc.'s Responsive Claim Construction Brief filed Oct. 27, 2021, Part 2.
*Samsung Electronics Co., Ltd.* v. *Lynk Labs, Inc.* Patent Owner—U.S. Pat. No. 10,154,551 Petition for Inter Parties Review of U.S. Pat. No. 10,154,551—90 pages.
*Samsung Electronics Co., Ltd.* v. *Lynk Labs, Inc.* Patent Owner—U.S. Pat. No. 10,154,551 Power of Attorney for Petitioner Samsung Electronics, Co., Ltd. U.S. Pat. No. 10,154,551—3 pages.
*Samsung Electronics Co., Ltd.* v. *Lynk Labs, Inc.* Patent Owner—U.S. Pat. No. 10,652,979 Petition for Inter Partes Review of U.S. Pat. No. 10,652,979—84 pages.
*Samsung Electronics Co., Ltd.* v. *Lynk Labs, Inc.* Patent Owner—U.S. Pat. No. 10,652,979 Power of Attorney for Petitioner Samsung Electronics, Co., Ltd. U.S. Pat. No. 10,652,979—3 pages.
*Samsung Electronics Co., Ltd.* v. *Lynk Labs, Inc.* Patent Owner—U.S. Pat. No. 10,154,551 Declaration of R. Jacob Baker, PH.D., P.E. In support of Petition for Inter Partes Review of U.S. Pat. No. 10,154,551—175 pages—Ex. 1002.
R. Jacob (Jake) Baker, Ph.D., P.E. CV—36 pages, Patents '252, '298, '466, '551, '674, '697, '979—Ex-1003
File History U.S. Pat. No. 10,154,551 U.S. Appl. No. 15/797,806 dated Oct. 30, 2017—Ex. 1004.
Williams, Tim "The Circuits Designer's Companion," 2021, 314 pages—(Parts 1 and 2), '551 Ex. 1013.
Chambers, Dictionary of Science and Technology, published Chambers Harrap Publishers Ltd 1999, 8 pages, '551—Ex. 1024.
*Samsung Electronics Co. Ltd. and Samsung Electronics America, Inc.* v. *Lynk Labs, Inc.* Defendant Lynk Labs, Inc.'s Supplement to Second Amended Preliminary Infringement Contentions ('551 Patent and '979 Patent), Case No. 1:21-cv-02665, filed Sep. 22, 2021, 14 pages—Ex. 1072.

(56) References Cited

OTHER PUBLICATIONS

*Lynk Labs, Inc.* v. *Samsung Electronics Co. Ltd. and Samsung Electronics America, Inc.* Case No. 6:21-cv-00526 Complaint for Patent Infringement filed May 25, 2021, '551 12 pages—Ex. 1074.
*Lynk Labs, Inc.* v. *Samsung Electronics Co. Ltd. and Samsung Electronics America, Inc.* Case No. 6:21-cv-00526 First Amended Complaint for Patent Infringement filed Jun. 9, 2021, 18 pages—Ex. 1075.
*Samsung Electronics Co. Ltd. and Samsung Electronics America, Inc.* v. *Lynk Labs, Inc.* Samsung Electronics Co., Ltd. and Samsung Electronics America, Inc,'s Second Amended Complaint for Declaratory Judgment of Non-Infringement, Case No. 1:21-cv-02665, filed Sep. 8, 2021, 44 pages—Ex. 1076.
*Samsung Electronics Co. Ltd. et al.* v. *Lynk Labs, Inc.* Civil Docket for Case #1:21-cv-02665 dated Sep. 27, 2021 '551 12. pages—Ex. 1077.
*Lynk Labs, Inc.* v. *Samsung Electronics Co. Ltd. et al.* Civil Docket for Case#6:21-cv-00526-ADA dated Sep. 27, 2021 '551 8 pages—Ex. 1078.
*Lynk Labs, Inc.* v. *Samsung Electronics Co. Ltd. et al.* Civil Docket for Case #1:21-cv-05126 dated Sep. 29, 2021 '551 8 pages—Ex. 1079.
*Lynk Labs, Inc.* v. *Samsung Electronics Co. Ltd. et al.* Case No. 6:21-cv-00526-ADS Order Granting Plaintiff Lynk Labs, Inc.'s Stipulation to Transfer '551 2 pages—Ex. 1080.
*Samsung Electronics Co., Ltd.* v. *Lynk Labs, Inc.* Patent Owner—U.S. Pat. No. 10,652,979 Declaration of R. Jacob Baker, PH.D., P.E. In support of Petition for Inter Partes Review of U.S. Pat. No. 10,652,979—174 pages—Ex. 1002.
McGraw-Hill Dictionary of Scienfific and Technical Term, Sixth Edition, '979—9 pages—Ex. 1018.
Declaration of R. Jacob Baker. Ph.D., P.E. U.S. Pat. No. 10,154,551, Inter Partes Review of U.S. Pat. No. 10,154,551, 176 pages—Ex 1002.
*Home Depot USA, Inc.*, v. *Lynk Labs, Inc.* Case IPR2021-01540, U.S. Pat. No. 10,091,842—Declaration of Dr. Lebby; dated Oct. 2, 2018—158 pages—Ex. 1002.
U.S. Appl. No. 15/334,029, filed Oct. 25, 2016—646 pages—Ex. 1003.
*Lynk Labs, Inc.* v. *Home Depot USA, Inc., The Home Depot Inc. and Home Depot Product Authority, LLC*, Case No. 6:21-cv-00097-ADA, Complaint for Patent Infringement filed Jan. 29, 2021—88 pages—Ex. 1004
*Lynk Labs, Inc.* v. *Home Depot USA, Inc., The Home Depot Inc. and Home Depot Product Authority, LLC*, Case No. 6:21-cv-00097-ADA, Scheduling Order filed Aug. 13, 2021—4 pages—Ex. 1006.
Signalized Intersection Safety in Europe, Dec. 2003, Publication No. FHWA-PL-02-020, Office of International Programs; International @fhwa.dot.gov; www.international.fhwa.dot.gov—126 pages—Ex. 1010.
Ohno et al., "Traffic Light Queues with Departure Headway Depending Upon Positions," Kyoto University, J. Operations Research So. of Japan. vol. 17, No. 3, Sep. 3, 1974—pp. 146-169—Ex. 1011.
U.S. Appl. No. 61/333,963, filed May 12, 2010—52 pages—Ex. 1021.
U.S. Appl. No. 61/284,927, filed Dec. 28, 2009—26 pages—Ex. 1022.
U.S. Appl. No. 61/335,069, filed Dec. 31 2009—36 pages—Ex. 1023.
U.S. Appl. No. 60/997,711, filed Oct. 6, 2007—24 pages—Ex. 1024.
U.S. Appl. No. 60/547,653, filed Feb. 25, 2004—83 pages—Ex. 1025.
U.S. Appl. No. 60/559,867, filed Feb. 25, 2004—89 pages—Ex. 1026.
U.S. Appl. No. 60/217,215, filed May 28, 2009—32 pages—Ex. 1027.
U.S. Appl. No. 61/215,144, filed May 1, 2009—11 pages—Ex. 1028.
E. Fred Schubert, "Light Emitting Diodes," Rensselaer Polytechnic Instititute, Cambridge University Press, 2002—327 page—Ex. 1030.
IEEE 100 The Authoritative Dictionary of IEEE Standards Terms, Seventh Edition—4 pages—Ex. 1032.
*Lynk Labs, Inc.* v. *Home Depot USA, Inc., The Home Depot Inc. and Home Depot Product Authority, LLC*, Case No. 6:21-cv-00097-ADA, Preliminary Lynk Labs, Inc.'s Amended Preliminary Infringement Contentions filed Jun. 23, 2021. 264 pages—Ex. 1005 (excerpts).
*Lynk Labs, Inc.* v. *Home Depot USA, Inc., The Home Depot Inc. and Home Depot Product Authority, LLC*, Case No. 6:21-cv-00097-ADA, Preliminary Lynk Labs, Inc.'s Amended Preliminary Infringement Contentions filed Jun. 23, 2021, 100 pages—Ex. 1012 (Part 1).
*Lynk Labs, Inc.* v. *Home Depot USA, Inc., The Home Depot Inc. and Home Depot Product Authority, LLC*, Case No. 6:21-cv-00097-ADA, Preliminary Lynk Labs, Inc.'s Amended Preliminary Infringement Contentions filed Jun. 23, 2021, 102—Ex. 1012 (Part 2).
*Lynk Labs, Inc.* v. *Home Depot USA, Inc., The Home Depot Inc. and Home Depot Product Authority, LLC*, Case No. 6:21-cv-00097-ADA, Preliminary Lynk Labs, Inc.'s Amended Preliminary Infringement Contentions filed Jun. 23, 2021, 102 pages—Ex. 1012 (Part 3).
*Lynk Labs, Inc.* v. *Home Depot USA, Inc., The Home Depot Inc. and Home Depot Product Authority, LLC*, Case No. 6:21-cv-00097-ADA, Preliminary Lynk Labs, Inc.'s Amended Preliminary Infringement Contentions filed Jun. 23, 2021, 142 pages—Ex. 1012 (Part 4).
*Home Depot USA, Inc.*, v. *Lynk Labs, Inc.*, Case No. IPR2021-01540, U.S. Pat. No. 10,091,842, Petition for Inter Partes Review, dated Oct. 2, 2018—74 pages.
*Home Depot USA, Inc.*, v. *Lynk Labs, Inc.*, Case No. IPR2021-01540, U.S. Pat. No. 10,091,842, Notice of Filing Date Accorded to Petition and Time for Filing Patent Owner Preliminary Response—dated Oct. 15, 2021—6 pages.
*Home Depot USA, Inc.*, v. *Lynk Labs, Inc.*, Case No. IPR2021-01540, U.S. Pat. No. 10, 091,842, Petitioner's Power of Attorney, dated Oct. 2, 2018—2 pages.
*Home Depot USA, Inc.*, v. *Lynk Labs, Inc.*, Case No. IPR2021-01540, U.S. Pat. No. 10,091,842, Patent Owner's Mandatory Notice Pursuant to 37 C.F.R. Section 42.8 filed Oct. 22, 2021—6 pages.
*Home Depot USA, Inc.*, v. *Lynk Labs, Inc.*, Case No. IPR2021-01541, U.S. Pat. No. 10,537,001, Declaration of Dr. Dena Neikirk, filed Feb. 12, 2019, dated Jan. 14, 2020.
U.S Appl. No. 16/274,164, filed Feb. 12, 2019—543 pages—Ex. 1003.
*Lynk Labs, Inc.*, v. *Home Depot USA, Inc., The Home Depot Inc., and Home Depot Product Authority, LLC*, Case No. 6:21-cv-000097, Complaint for Patent Infringement Case dated Jan. 29, 2021—88 pages—Ex. 1011.
*Lynk Labs, Inc.*, v. *Home Depot USA, Inc., The Home Depot Inc., and Home Depot Product Authority, LLC*, Case No. 6:21-cv-00097-ASA, Scheduling Order filed Aug. 13, 2021—4 pages—Ex. 1013.
*Lynk Labs, Inc.*, v. *Home Depot USA, Inc., The Home Depot Inc., and Home Depot Product Authority, LLC*, Case No. 6:21-cv-00097-ADA, Defendants' Opening Claim Construction Brief on the Terms of U.S. Pat. Nos. 10,081,842, 10,154,551, 10,349,479, 10,492,251, 10,517,149, 10,537,001, 10,562,979, 10,757,783, and 10,932,341 filed Oct. 6, 2021—38 pages—Ex. 1019.
Response to Final Office Action U.S. Appl. No. 15/369,218, filed Jun. 13, 2018, 10 pages—Ex. 1020.
Non-Final Office Action U.S. Appl. No. 15/636,918 dated Oct. 2, 2018, 11 pages—Ex. 1021.
Non-Final Office Action U.S. Appl. No. 16/440,884 dated Jul. 23, 2019, 10 pages—Ex. 1023.
Continuation Application U.S. Appl. No. 16/369,219—orginal claims—Ex. 1024.
Response to Office Action U.S. Appl. No. 16/440,884, 11 pages—Ex. 1026.
*Home Depot USA, Inc.*, v. *Lynk Labs, Inc.*, Case No. IPR2021-01541, filed Feb. 12, 2019, dated Jan. 14, 2020, Petition for Inter Partes Review of U.S. Pat. No. 10,537,001 Under 35 U.S.C. Section 311-319 and 37 C.F.R. Section 42.1-100, ET SEQ., 82 pages.
*Home Depot USA, Inc.*, v. *Lynk Labs, Inc.*, Case No. IPR2021-01541, U.S. Pat. No. 10,537,001, Petitioner's Power of Attorney, dated Jan. 14, 2020—2 pages.

(56) References Cited

OTHER PUBLICATIONS

*Home Depot USA, Inc.*, v. *Lynk Labs, Inc.*, Case No. IPR2021-01541, U.S. Pat. No. 10,537,001, Patent Owner's Mandatory Notice Pursuant to 37 C.F.R. Section 42.8 filed Nov. 10, 2021—6 pages.
*Samsung Electronics Co., Ltd.* v. *Lynk Labs, Inc*. U.S. Pat. No. 10,492,251 Petition for Inter Partes Review of U.S Pat. No. 10,492,251, 95 pages.
*Samsung Electronics Co., Ltd.* v. *Lynk Labs, Inc*. U.S. Pat. No. 10,492,251 Power of Attorney for Petitioner Samsung Electronics Co., Ltd. 3 pages.
*Samsung Electronic Co., Ltd.* v. *Lynk Labs, Inc*. U.S Pat. No. 10,492,251 Petitioner's Notice Regarding Multiple Petitions, 9 pages.
*Samsung Electronics Co., Ltd.* v. *Lynk Labs, Inc*. Case: IPR2002-00051, U.S. Pat. No. 10,492,251 Patent Owner's Mandatory Notices Pursuant to 37 C.F.R. Section 42.8, 5 pages.
*Samsung Electronics Co., Ltd.* v. *Lynk Labs, Inc.*, U.S. Pat. No. 10,492,251 Declaration of R. Jacob Baker, Ph.D., P.E. In Support of Petition for Inter Partes Review of U.S. Pat. No. 10,492,251, 173 pages—Ex. 1002.
U.S. Appl. No. 16/148,945, filed Feb. 15, 2019, 309 pages—Ex. 1004.
U.S. Appl. No. 61/331,225, filed May 4, 2010, 63 pages—Ex. 1010.
Watson Mastering Electronics, Third Edition, pp. 1-151—Ex. 1012 and Ex. 1018.
Stan Gibilisco, Handbook of Radio & Wireless Technology, pp. 1-188—Ex. 1013.
Defendant Lynk Labs, Inc.'s Response to Plaintiffs' Intial Non-Infringement, Unenforceability, and Invalidity Contentions, 51 pages—Ex. 1038.
File History for U.S. Pat. No. 9,198,237 dated May 18, 2011—part 2, 321 pages—Ex. 1039.
Sedraa/Smith, "Microelectronic Circuits," Fourth Edition, Part 1 of 4, pp. 1-161—Ex. 1041, Ex. 1061, ex, 1054.
Sedra/Smith, "Microelectronic Circuits," Fourth Editon, Part 2 of 4, pp. 162-1048 pages—Ex. 1041, Ex. 1061, Ex. 1054.
Sedra/Smith, "Microelectronic Circuits," Fourth Edition, Part 3 of 4, pp. 1049-1230 pages—Ex. 1041, Ex. 1061, Ex. 1054.
Tim Williams, The Circuit Designer's Companion, First Published 1991, ISBN 0 7506 1142 1, 314 pages—Ex. 1042, Ex. 1094.
Chamber Dictionary of Science and Technology, General Editior Professor Peter MB Walker, CBE, FRSE, Chambers Harrap Published Ltd. 1999 ISBN 0 550 14110 3, 4 pages—Ex. 1047, Ex. 1024.
McGraw-Hill Dictionary of Scientific and Technical Terms, Sixth Edition, Library of Congress Cataloging in Publication Data, ISBN 0-07-042313-X, pp. 4—Ex. 1048, Ex. 1018.
PCT File History US/2011/36359, filed May 12, 2011—Ex. 1050.
PCT File History US/2010/62235, filed Dec. 28, 2010—Ex. 1052, Ex. 1039.
U.S. Provisional Application filed May 12, 2010—Ex. 1063.
U.S. Provisonal Application filed Dec. 28, 2009—Ex. 1061.
U.S. Provisional Application filed Dec. 31, 2009—Ex. 1065.
U.S. Appl. No. 60/547,653, filed Feb. 25, 2004—Ex. 1067.
U.S. Appl. No. 60/559,867, filed Feb. 25, 2004—Ex. 1068.
U.S. Appl. No. 62/217,215, filed May 28, 2009—Ex. 1069.
Civil Docket for Case#6:21-cv-02665, Northern Districe of Illinois, Samsung Electronics. Co., Ltd. filed May 17, 2021, 14 pages—Ex. 1076, Ex. 1061.
Civil Docket for Case#6:21-cv-00097-ADA, Western District of Texas (Waco)—Lynk Labs, Inc. filed Jan. 29, 2001, 9 pages—Ex. 1077, Ex. 1074.
US District Court for the Northern District of Illinois, Estimated Patent Case Schedule, 2 pages—Ex. 1079, Ex. 1062.
*Samsung Electronics Co., Ltd. and Samsung Electronics America, Inc.*, v. *Lynk Labs, Inc.*, Case No. 1:21-cv-02665—Supplemental Report of Parties'Planning Meeting, file Oct. 14, 2021, 11 pages—Ex. 1080, Ex. 1075.
*Samsung Electronics Co., Ltd. and Samsung Electronics America, Inc.*, v. *Lynk Labs, Inc.*, Case No. 1:21-cv-02665—Defendant Lynk Labs, Inc's Answer to Plaintiffs Samsung Electronics Co., Ltd and Samsung Electronics America, Inc. 's First Amended Complaint and Counterclaims, filed Aug. 3, 2021, 67 pages—Ex. 1082, Ex. 1071.
*Samsung Electronics Co., Ltd. and Samsung Electronics America, Inc.*, v. *Lynk Labs, Inc.*, Case No. 1:21-cv-02665—Defendant Lynk Labs, Inc.'s Amended Preliminary Infringement Contentions, 9 pages—Ex. 1083, Ex. 1066.
U.S. Pat. No. 10,492,251 ("the '251 Patent") Exemplary Infringement Contention Claim Charts, Appendix A-1 through J-1—Ex. 1084.
*Samsung Electronics Co., Ltd. et al.* v. *Lynk Labs, Inc*. Case No. 1:21-cv-02665, Notification of Docket Entry Jul. 27, 2021, 1 page—Ex. 1085, Ex. 1068.
*Samsung Electronics Co., Ltd., and Samsung Electronics America, Inc.* v. *Lynk Labs, Inc.*, No. 21 C 2665, Order dated Aug. 19, 2021—Ex. 1086.
*Samsung Electronics Co., Ltd. et al.* v. *Lynk Labs, Inc*. Case No. 1:21-cv-02665, Notification of Docket Entry Oct. 18, 2021, 1 page—Ex. 1087, Ex. 1070.
*Lynk Labs, Inc.*, v. *Home Depot USA, Inc., The Home Depot Inc., and Home Depot Product Authority, LLC*Case No. 6:21-cv-00097, Complaint for Patent Infringement dated Jan. 29, 2021, 88 page—Ex. 1088, Ex. 1072.
*Lynk Labs, Inc.*, v. *Home Depot USA, Inc., The Home Depot Inc., and Home Depot Product Authority, LLC*, Case. No. 6:21-cv-00097-ADA, First Amended Complaint for Patent Infringement dated Mar. 17, 2021, 94 pages—Ex. 1089, Ex. 1073.
*Samsung Electronics Co., Ltd. et al.* v. *Lynk Labs, Inc*. Case IPR2022-00051, U.S. Pat. No. 10,492,251 Notice of Filing Date Accorded to Petition, dated Dec. 9, 2021, 5 pages.
*Samsung Electronics Co., Ltd.* v. *Lynk Labs, Inc*. U.S. Pat. No. 10,687,400, Declaration of R. Jacob Baker Ph.D., P.E. In Support of Petiition for Inter Partes Review of U.S. Pat. No. 10,687,400 dated Nov. 5, 2021—177 pages Ex. 1002.
U.S. Appl. No. 61/333,963, filed May 12, 2010 Ex. 1063.
U.S. Appl. No. 61/284,927, filed Dec. 28, 2009 Ex. 1067.
U.S. Appl. No. 61/335,069, filed Dec. 31, 2009 Ex. 1068.
U.S. Appl. No. 60/997,771, filed Oct. 6, 2007 Ex. 1066.
U.S. Appl. No. 60/547,653, filed Mar. 2, 2004 Ex. 1067.
U.S. Appl. No. 60/559,867, filed Apr. 8, 2004 Ex. 1068.
U.S. Appl. No. 61/217,215, filed May 28, 2009 Ex. 1069.
U.S. Appl. No. 61/215,144, filed May 1, 2099 Ex. 1070.
Docket from *Samsung Electronics Co., Ltd. et al* v. *Lynk Labs, Inc*. No. 1:21-cv-02665 printed Nov. 5, 2021—14 pages Ex. 1076
"Defendant Lynk Labs, Inc.'s Preliminary Infringement Contentions" from *Samsung Electronics Co. Ltd. et al* v. *Lynk Labs, Inc.*, Case No. 1:21-cv-02665 filed Jul. 21, 2021—9 pages Ex. 1080.
"Defendant Lynk Labs, Inc.'s Answer to Plaintiffs Samsung Electronics Co., Ltd. and Samsung Electronics America, Inc.'s First Ameneded Complaint and Counterclaims" from *Samsung Electronics Co. Ltd. et al* v. *Lynk Labs, Inc.*, Case No. 1:21-cv-02665 filed Aug. 3, 2021—67 pages Ex. 1082, Ex. 1071.
"Defendant Lynk Labs, Inc.'s Amended Preliminary Infringement Contentions" from *Samsung Electronics Co. Ltd. et al* v. *Lynk Labs, Inc.*, Case No. 1:21-cv-02655 filed Aug. 31, 2021—9 pages Ex. 1083, Ex 1066.
"Notification of Docket Entry" from *Samsung Electronics Co. Ltd. et al* v. *Lynk Labs, Inc.*, Case No. 1:21-cv-02665 filed Jul. 27, 2021—1 page Ex. 1085, Ex. 1068.
"Order" from *Samsung Electronics Co. Ltd. et al* v. *Lynk Labs, Inc.*, Case No. 1:21-cv-02665, filed Aug. 19, 2021—2 pages Ex. 1086
"Supplemental Report of Parties'Planning Meeting" from *Samsung Electronics Co. Ltd. et al* v. *Lynk Labs, Inc.*, Case No. 1:21-cv-02665, filed Oct. 14, 2021—11 pages Ex. 1087, Ex. 1075, Ex. 1080.
"Defendant Lynk Labs, Inc.'s Supplement to Second Amended Preliminary Infringment Contentions ('551 Patent and 979 Patent)" from *Samsung Electronics Co. Ltd. et al* v. *Lynk Labs, Inc.*, Case No. 1:21-cv-02665, filed Sep. 22, 2021—20 pages Ex. 1072.
"Order" from *Samsung Electronics Co. Ltd. et al* v. *Lynk Labs, Inc.*, Case No. 1:21-cv-02665, filed Oct. 18, 2021—1 page Ex. 1088.
Tim Williams, The Circuit Designer's Campanion, First Published 1991, ISBN 0 7506 1142 1, 314 pages—Ex. 1089, Ex. 1094.

(56) References Cited

OTHER PUBLICATIONS

*Samsung Electronics Co., Ltd.* v. *Lynk Labs, Inc*. U.S. Pat. No. 10,687,400, Petition for Inter Partes Review of U.S. Pat. No. 10,687,400 dated Nov. 12, 2021—96 pages.
*Samsung Electronics Co., Ltd.* v. *Lynk Labs, Inc*. U.S. Pat. No. 10,687,400, Power of Attorney for Petitioner Samsung Electronics Co., Ltd. dated Oct. 8, 2021—3 pages.
*Samsung Electronics Co., Ltd.* v. *Lynk Labs, Inc*. U.S. Pat. No. 10,687,400, Petitioner's Notice Regarding Multiple Petitions dated Nov. 12, 2021—9 pages.
*Samsung Electronics Co., Ltd.* v. *Lynk Labs, Inc*. U.S. Pat. No. 10,687,400, Patent Owner's Mandatory Notices Pursuant to 37 C.F.R. § 42.8 dated Nov. 19, 2021—5 pages.

* cited by examiner

LED CIRCUITS AND ASSEMBLIES

PRIORITY CLAIM

This application is a continuation of U.S. patent application Ser. No. 15/334,001, filed Oct. 25, 2016, which is a continuation-in-part of U.S. patent application Ser. No. 14/172,644, filed Feb. 4, 2014, now U.S. Pat. No. 9,750,098, which is a continuation of U.S. patent application Ser. No. 13/322,796, filed Nov. 28, 2011, now U.S. Pat. No. 8,648,539, which is a national phase application of International Application No. PCT/US2010/001597, filed May 28, 2010, which claims priority to U.S. Provisional Application No. 61/217,215, filed May 28, 2009, and is a continuation-in-part of U.S. patent application Ser. No. 12/287,267, filed Oct. 6, 2008, now U.S. Pat. No. 8,179,055, which claims the priority to U.S. Provisional Application No. 60/997,771, filed Oct. 6, 2007; the contents of each of these applications are expressly incorporated herein by reference.

TECHNICAL FIELD

The present invention relates generally to light-emitting diode ("LED") circuits and assemblies; and more specifically to scalable alternating current ("AC") driven LED circuits and assemblies.

SUMMARY

While not intending to limit the scope of the claims or disclosure, in brief summary, the present disclosure and claims are directed to providing improved ease of designing and building lighting fixtures using AC-driven LEDs. Disclosed and claimed are LED circuits having scalable circuit configurations and LED package assembly configurations which can be used in an AC-drive platform to more easily match the voltage requirements of the lighting fixture(s) or systems in which the LED's are desired. Circuits and LED package assemblies are claimed and disclosed which reduce objectionable flicker produced from AC-driven LEDs and to produce more light per component. Packaged LED's are provided for lighting design according to the invention, which address flicker at low frequencies (e.g. 50/60 Hz) while being scalable as desired for a particular lighting goal without resort to designing individual assemblies at the semiconductor die level. Circuits are also disclosed and claimed which provide for some of the LEDs in a circuit to be on during both positive and negative phases of an AC source, to among other things, address flicker. Also, circuits are claimed and disclosed where a basic circuit design provides a voltage and current performance whereby scalability or matching a particular voltage requirement is achieved by configuring LEDs in the basic design and/or by joining one or more of the basic circuits together in series or parallel to achieve the design requirement.

According to an embodiment of the invention, an AC-driven LED circuit is proposed having a first parallel circuit having LEDs. Each LED has an input and an output, and the circuit having at least first and second branches connecting at first and second common points, the common points providing input and output for an AC driving current for the circuit. The first branch having a first and a second LED, and the second branch having a third and a fourth LED. The first LED is connected to the second LED in opposing series relationship with the inputs of the first and second LEDs defining a first branch junction. The third LED is connected to the fourth LED in opposing series with the outputs of the third and fourth LEDs defining a second branch junction. The first and second branches are connected to one another such that the output of the first LED is connected to the input of the third LED at the first common point and the output of the second LED is connected to the input of the fourth LED at the second common point. A first cross-connecting circuit branch having at least a fifth LED, the first cross-connecting circuit being configured such that the input of the fifth LED is connected to second branch junction and the output is connected to the first branch junction.

According to another embodiment of the invention, an AC-driven LED circuit may comprise one or more additional parallel circuits each being the same as the first parallel circuit identified above. Each additional circuit being conductively connected to the first parallel circuit and to one another at their common points for providing an input and an output for an AC driving current of the circuit. According to other embodiments, the additional parallel circuits may be connected in series to the first parallel circuit and to one another or the additional parallel circuits may be connected in parallel to the first parallel circuit and to one another.

According to another embodiment of the invention, n additional LEDs, in pairs, may be provided in the circuit wherein the pairs are configured among the first and second branch circuits of each of the respective parallel circuits, such that current flows through the respective fifth diode of each parallel circuit upon both a negative and positive phase of the AC driving source and so that the current draw through each of the respective parallel circuits during both AC phases is substantially the same.

According to another embodiment, the AC-driven LED circuit further comprises x cross-connecting circuit branches each having one or more LEDs and being configured such that current flows through each of the respective one or more LEDS upon both a negative and positive phase of the AC driving source and so that the current draw through each of the respective parallel circuits during both AC phases is substantially the same.

According to another embodiment of the invention, an AC-driven LED assembly comprises at least a first and a second LED each discretely packaged, the LEDs being connected in an AC circuit and each LED package being mounted to a substrate at a distance from the other of preferably approximately 3 mm or less, and more preferably 2.0 mm or less. In an embodiment the packaged LEDs also each have a length of preferably approximately 2.5 mm or less, and more preferably 2.0 mm or less. In an embodiment the packaged LEDs also each have a width of preferably approximately 2.5 mm or less, and more preferably 2.0 mm or less. In an embodiment the LED packages are arranged with respect to each other in a linear spatial relationship while in another embodiment the LED packages are arranged with respect to each other in an XY rectilinear spatial relationship. In an embodiment of the invention, one or more LED packages may include a reflective material.

DETAILED DESCRIPTION

Figure 1:
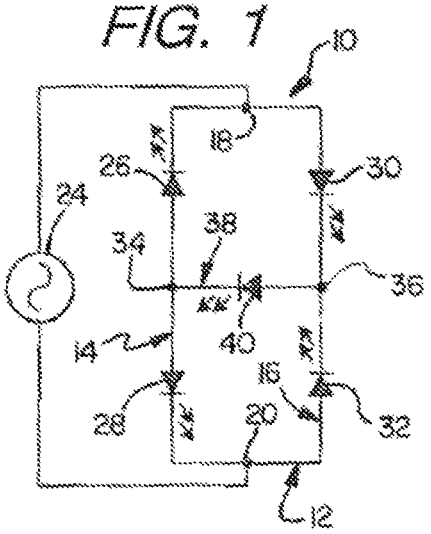
FIG. 1 is a schematic view of an AC-driven LED circuit, according to an embodiment of the invention.

While this invention is susceptible to embodiments in many different forms, there are shown in the drawings and will herein be described in detail, preferred embodiments of the invention with the understanding that the present disclosures are to be considered as exemplifications of the principles of the invention and are not intended to limit the broad aspects of the invention to the embodiments illustrated. Like components in the various FIGS. will be given like reference numbers.

FIG. 1 discloses an AC-driven LED circuit 10 including a first parallel circuit 12 having a first branch 14, and a second branch 16. Branches 14, 16 connect at first common point 18 and second common point 20. The common points 18, 20 provide input and output for an AC driving current from a driver 24 for the circuit. The driver may be, for example, mains power, an electronic transformer, or a magnetic transformer.

The first branch 14 has a first LED 26 and a second LED 28, and the second branch 16 having a third LED 30 and a fourth LED 32. The first LED 26 is connected to the second LED 28 in opposing series relationship with the inputs of the first and second LEDs 26, 28 defining a first branch junction 34. The third LED 30 is connected to the fourth LED 32 in opposing series with the outputs of the third and fourth LEDs 30, 32 defining a second branch junction 36.

The first and second branches 14, 16 are connected to one another such that the output of the first LED 26 is connected to the input of the third LED 30 at the first common point 18 and the output of the second LED 28 is connected to the input of the fourth LED 32 at the second common point 20. A first cross-connecting circuit branch 38 has a fifth LED 40. The first cross-connecting circuit branch 38 being configured such that the input of the fifth LED 40 is connected to second branch junction 36 and the output is connected to the first branch junction 34.

As will be appreciated by those of skill in the art, the LEDs 26 and 32 provide light only upon one half of an AC wave, pulse or phase, while the LEDs 28 and 30 will provide light only upon the opposite wave, pulse or phase. At lower frequencies, e.g. mains frequencies, if the LEDs are spaced pursuant to another aspect of the invention (disclosed below) at preferably approximately 3.0 mm or less preferably approximately 2.0 mm or less, then the amount of noticeable flicker may not be unacceptable. However, the cross connecting circuit 38 and diode 40 will be on (produce light) in both phases of the AC drive and hence mitigate flicker which may be evidenced in its surrounding LEDs 26, 28, 30 and 32.

Figure 2:
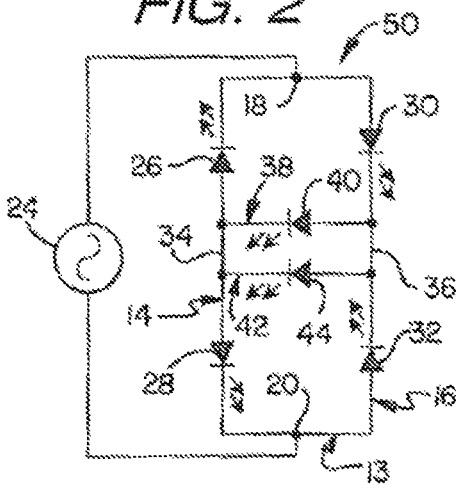
FIG. 2 is a schematic view of an AC-driven LED circuit, according to an embodiment of the invention.
Figure 9:
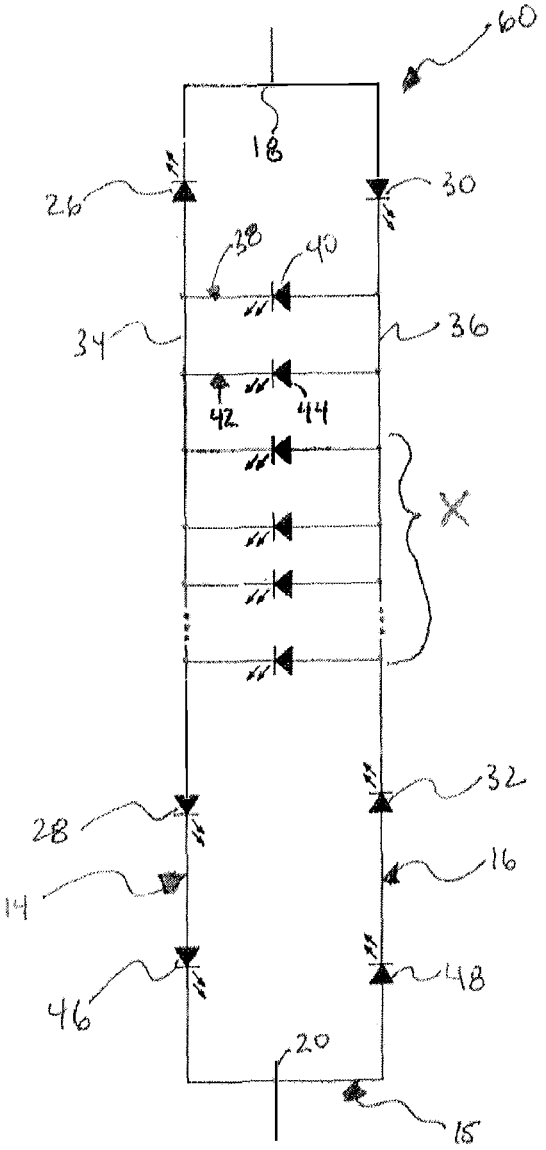
FIG. 9 is a schematic view of an AC-driven LED circuit, according to an embodiment of the invention.

FIG. 2 discloses an AC-driven LED circuit 50 which is a modification of AC-driven LED circuit 10. Circuit 50 further mitigates flicker. Circuit 50 provides an additional cross-connecting circuit branch 42 having LED 44. The LEDS 40, 44 are configured such that current flows through each upon both a negative and positive phase of the AC driving source 24. It should be appreciated that according to the invention x number of such cross connecting circuit branches (such as 38, 42) may be added as desired (see for example FIG. 9), however, since the LEDs (such as LEDs 40, 44) are in parallel with each other, their voltage demand will be divided while their current draw will not. Hence a suitable driver need be provided for this circumstance.

Figure 3:
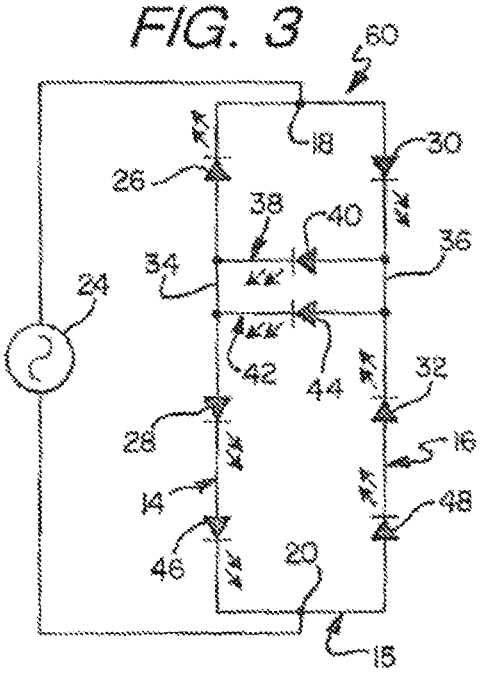
FIG. 3 is a schematic view of an AC-driven LED circuit, according to an embodiment of the invention.
Figure 10:
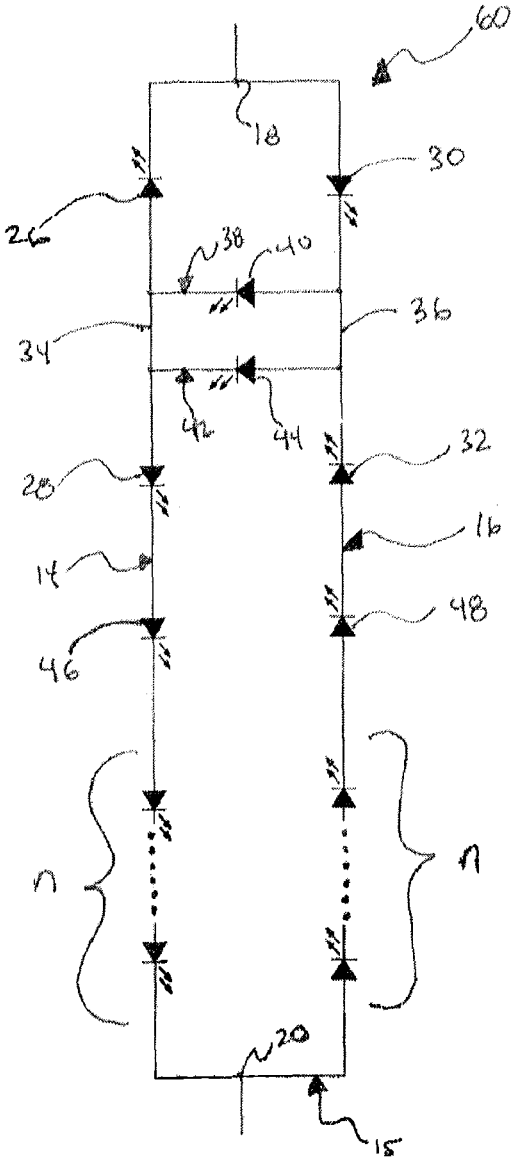
FIG. 10 is a schematic view of an AC-driven LED circuit, according to an embodiment of the invention.

To increase the light output of the circuit of the invention, it should be noted as disclosed in FIGS. 3 and 10 that additional or n LEDS may be provided in the branches 14 and 16. Specifically FIG. 3 discloses an AC-driven circuit 60 which is a modification of circuit 50. Circuit 60 provides for additional LEDs 46 and 48. The pair of LEDs are configured among the first and second branch circuits 14, 16 of the parallel circuit 15 such that current flows through the respective diodes 40, 44 upon both a negative and positive phase of the AC driving source 24 and so that the current draw through parallel circuit 15 during both AC phases is substantially the same.

It should be noted that according to the invention, n pairs of LEDs can be configured among first and second branch circuits of a respective parallel circuit (see for e.g., FIG. 10), such that current flows through the respective cross connecting circuit branch LEDs of a parallel circuit upon both a negative and positive phase of the AC driving source and so that the current draw through each of the respective parallel circuits during both AC phases is substantially the same. More LEDs in the branch circuits divide the current from the higher current LEDs in cross connecting circuits 38, 42.

According to another aspect of the invention, to further mitigate the amount of flicker perceived, adding to the light provided and to scalability, additional parallel circuits, each being the same as the first parallel circuit, may be conductively connected to the first parallel circuit in series or parallel at the their common points 18, 20 for providing an input and an output for an AC driving current for the circuit.

Figure 4:
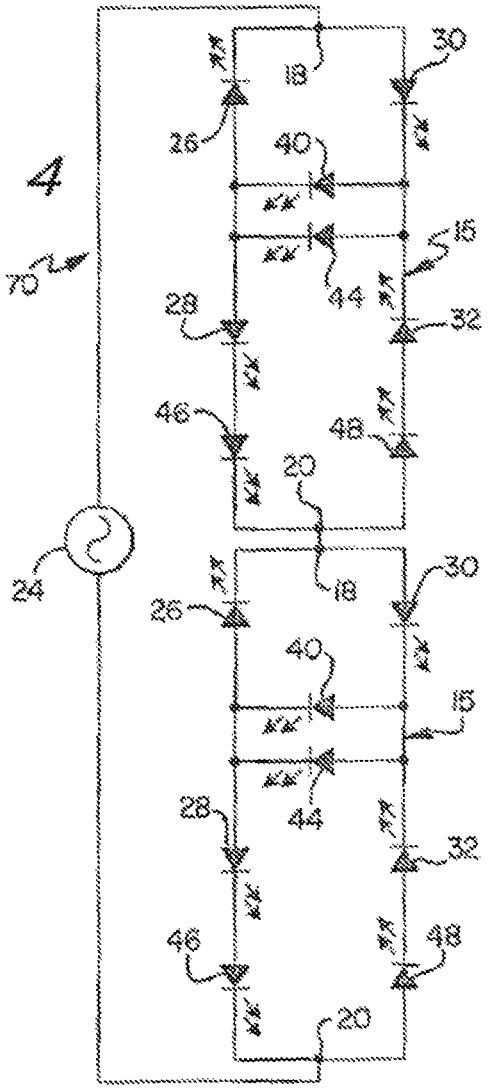
FIG. 4 is a schematic view of an AC-driven LED circuit, according to an embodiment of the invention.
Figure 5:
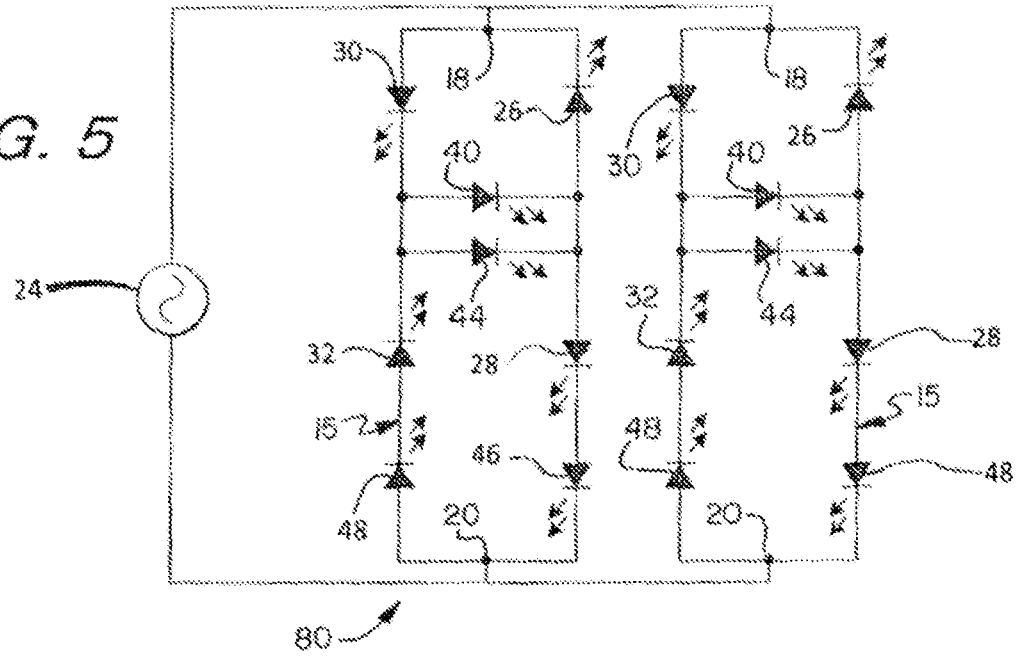
FIG. 5 is a schematic view of an AC-driven LED circuit, according to an embodiment of the invention.

For instance, FIG. 4 discloses an AC-driven LED circuit 70 which includes additional parallel circuits 15 connected in series at common points 18, 20. Additionally, as seen in FIG. 5, an AC-driven LED circuit 80 includes additional parallel circuits 15 connected in parallel at common points 18, 20. This embodiment shows the utility of providing a scalable circuit that can be manufactured modularly and used to connect to match higher voltage requirements e.g. circuit 15 may draw drawing 12 V AC while two such circuits 15 in series would meet 24 V AC requirements.

Preferably, the number and type of LEDs in the AC-driven LED circuit draws a combined current and combined voltage which is substantially equal to the nominal voltage capacity of the AC drive source.

Figure 6:
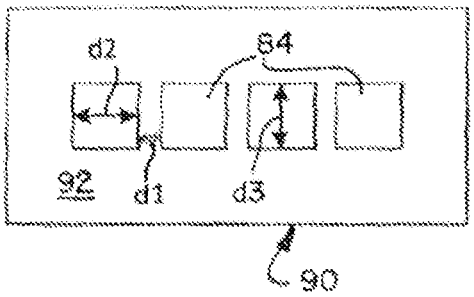
FIG. 6 is a schematic top view of an AC-driven LED assembly, according to an embodiment of the invention.

As shown in FIG. 6, an AC-driven LED assembly 90 has a first and a second LED 82 each discretely packaged, the LEDs being connected in an AC circuit and each LED package 82 being mounted to a substrate 92 at a distance d1 from the other of preferably approximately 3 mm or less, and more preferably 2.0 mm or less. The first and second LEDs may be, for example, discrete packaged semiconductor LED die or LED chips. The AC-driven LED assembly 90 also has packaged LEDs 84 each having a width d2 and a length d3 of preferably approximately 2.5 mm or less, and more preferably 2.0 mm or less.

Figure 7:
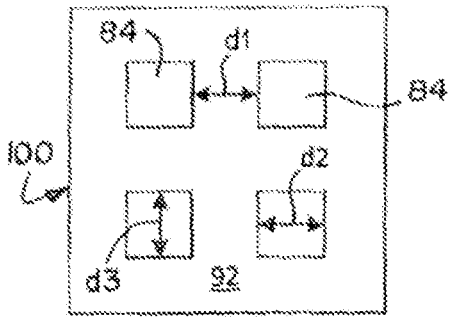
FIG. 7 is a schematic top view of an AC-driven LED assembly, according to an embodiment of the invention.

FIG. 6 discloses an AC-driven LED assembly 90 wherein the LED packages 84 are arranged with respect to each other in a linear spatial relationship, while FIG. 7 discloses an assembly 100 wherein the LED packages 84 are arranged with respect to each other in an XY rectilinear spatial relationship.

Figure 8:
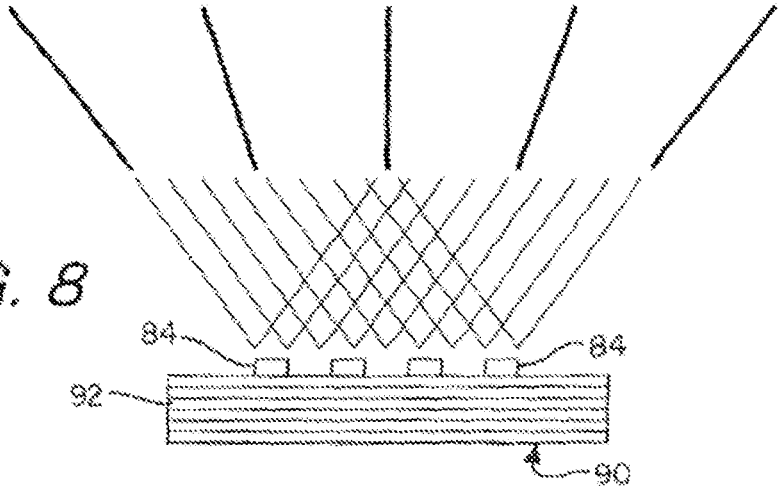
FIG. 8 is a schematic side view of an AC-driven LED assembly, according to an embodiment of the invention.

As can be seen in FIG. 8, when LED packages 84 are placed at 3 mm or less, the light produced there from intersects, thereby reducing or eliminating the effects of flicker.

Some standard AC voltages in the world include 12 VAC, 24 VAC, 100 VAC, 110 VAC, 120 VAC, 220 VAC, 230 VAC, 240 VAC and 277 VAC. Therefore, it would be advantageous to have a single chip LED or multi-chip single LED packages that could be easily configured to operate at multiple voltages by simply selecting a voltage and/or current level when packaging the multi-voltage and/or multi-current single chip LEDs or by selecting a specific voltage and/or current level when integrating the LED package onto a printed circuit board or within a finished lighting product. It would also be advantageous to have multi-current LED chips and/or packages for LED lamp applications in order to provide a means of increasing brightness in LED lamps by switching in additional circuits just as additional filaments are switched in for standard incandescent lamps.

It would further be advantageous to provide multiple voltage level and/or multiple brightness level light emitting LED circuits, chips, packages and lamps "multi-voltage and/or multi-brightness LED devices" that can easily be electrically configured for at least two forward voltage drive levels with direct AC voltage coupling, bridge rectified AC voltage coupling or constant voltage DC power source coupling. This invention comprises circuits and devices that can be driven with more than one AC or DC forward voltage "multi-voltage" at 6V or greater based on a selectable desired operating voltage level that is achieved by electrically connecting the LED circuits in a series or parallel circuit configuration and/or more than one level of brightness "multi-brightness" based on a switching means that connects and/or disconnects at least one additional LED circuit to and/or from a first LED circuit. The desired operating voltage level and/or the desired brightness level electrical connection may be achieved and/or completed at the LED packaging level when the multi-voltage and/or multi-brightness, circuits and/or single chips are integrated into the LED package, or the LED package may have external electrical contacts that match the integrated multi-voltage and/or multi-brightness circuits and/or single chips within, thus allowing the drive voltage level and/or the brightness level select-ability to be passed on through to the exterior of the LED package and allowing the voltage level or brightness level to be selected at the LED package user, or the PCB assembly facility, or the end product manufacturer.

It would further be advantageous to provide multi-brightness LED devices that can be switched to different levels of brightness by simply switching additional circuits on or off in addition to a first operating circuit within a single chip and or LED package. This would allow LED lamps to switch to higher brightness levels just like 2-way or 3-way incandescent lamps do today.

According to another aspect of the invention a multi-voltage and/or multi-current single chip AC LED and/or multi-voltage and/or multi-current AC LED package is integrated within an LED lamp. The LED lamp having a structure that comprises a heat sink, a lens cover and a standard lamp electrical base. The multi-voltage and/or multi-current single chip AC LED and/or package is configured to provide a means of switching on at least one additional single voltage AC LED circuit within multi-voltage and/or multi-current AC LED circuit to provide increased brightness from the LED lamp.

According to another aspect of the invention, at least one single chip multi-current LED bridge circuit is integrated within a LED lamp having a standard lamp base. The single chip multi-current LED bridge circuit may be electrically connected together in parallel configuration but left open to accommodate switching on a switch to the more than one on the single chip and have at least one accessible electrical contact at each opposing end of the two series connected circuits and one accessible electrical contact at the center junction of the at least two individual serially connected LED circuits. The at least two individual circuits are integrated within a single chip.

Figure 11:
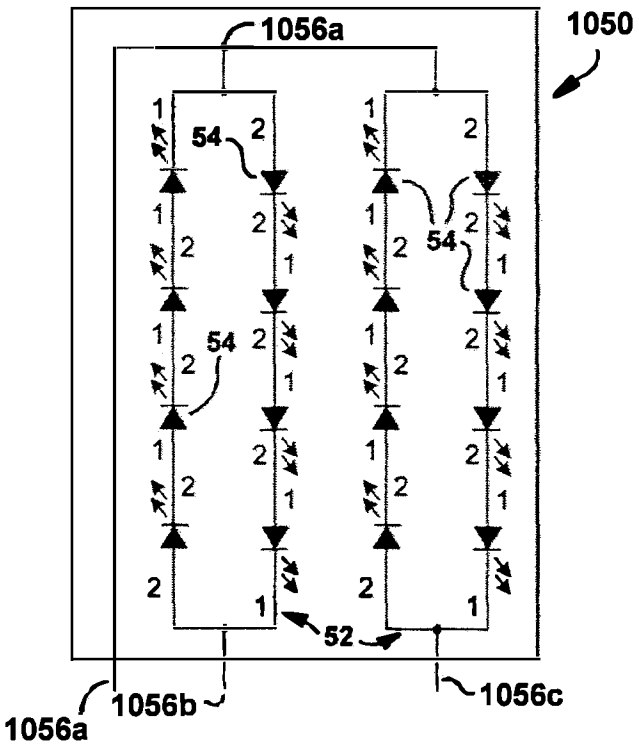
FIG. 11 is a schematic view of a multi-voltage and/or multi-brightness LED lighting device according to an embodiment of the invention.

FIG. 11 discloses a schematic diagram of a multi-voltage and/or multi-brightness LED lighting device 1050. The multi-voltage and/or multi-brightness LED lighting device 1050 comprises at least two AC LED circuits 1052, each of which have at least two LEDs 1054 in series and anti-parallel relation. The at leak two AC LED circuits 1052 have at least three electrical contacts 1056*a*, 1056*b* and 1056*c*. The at least two AC LED circuits 1052 are electrically connected together in parallel at one end 1056*a* and left unconnected at the opposing ends of the electrical contacts 1056*b* and 1056*c*. One side of an AC voltage source line is electrically connected to 1056*a* and the other side of an AC voltage source line is individually electrically connected to 1056*b* and 1056*c* with either a fixed connection or a switched connection thereby providing a first brightness when AC voltage is applied to 1056*a* and 1056*b* and a second brightness when an AC voltage is applied to 1056*a*, 1056*b* and 1056*c*. It is contemplated that the multi-voltage and/or multi-brightness LED lighting device 1050 is a single chip, an LED package, an LED assembly or an LED lamp. The multi-brightness switching capability.

Figure 12:
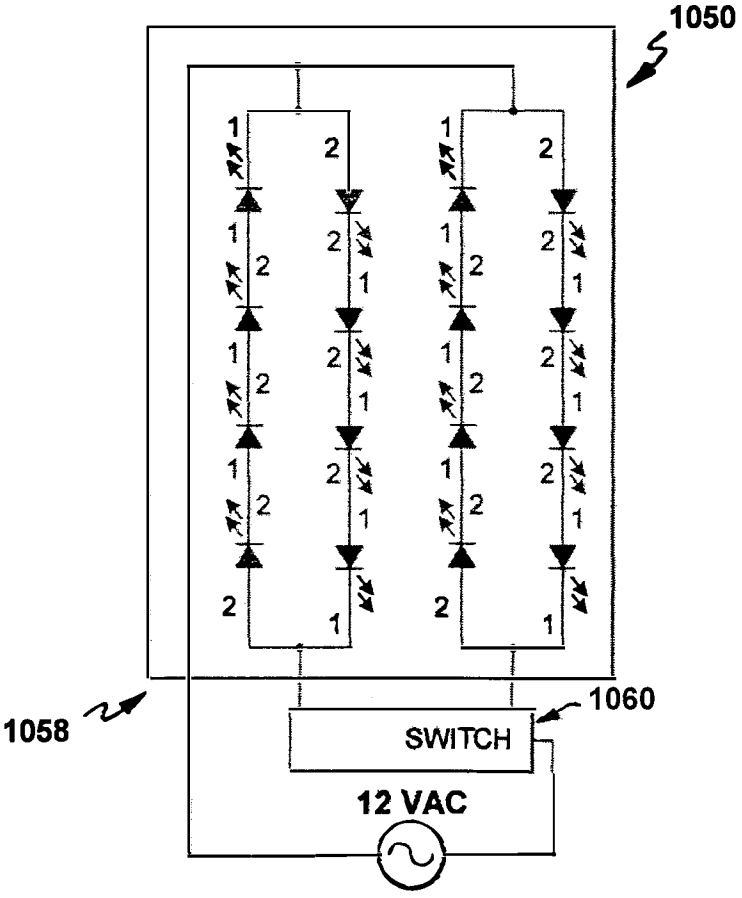
FIG. 12 is a schematic view of a multi-voltage and/or multi-brightness LED lighting device integrated within a lamp according to an embodiment of the invention.

FIG. 12 discloses a schematic diagram similar to the multi-voltage and/or multi-brightness LED device 1050 shown in FIG. 11 integrated within a lamp 1058 and connected to a switch 1060 to control the brightness level of the multi-voltage and/or multi-brightness LED lighting device 1050.

Figure 13:
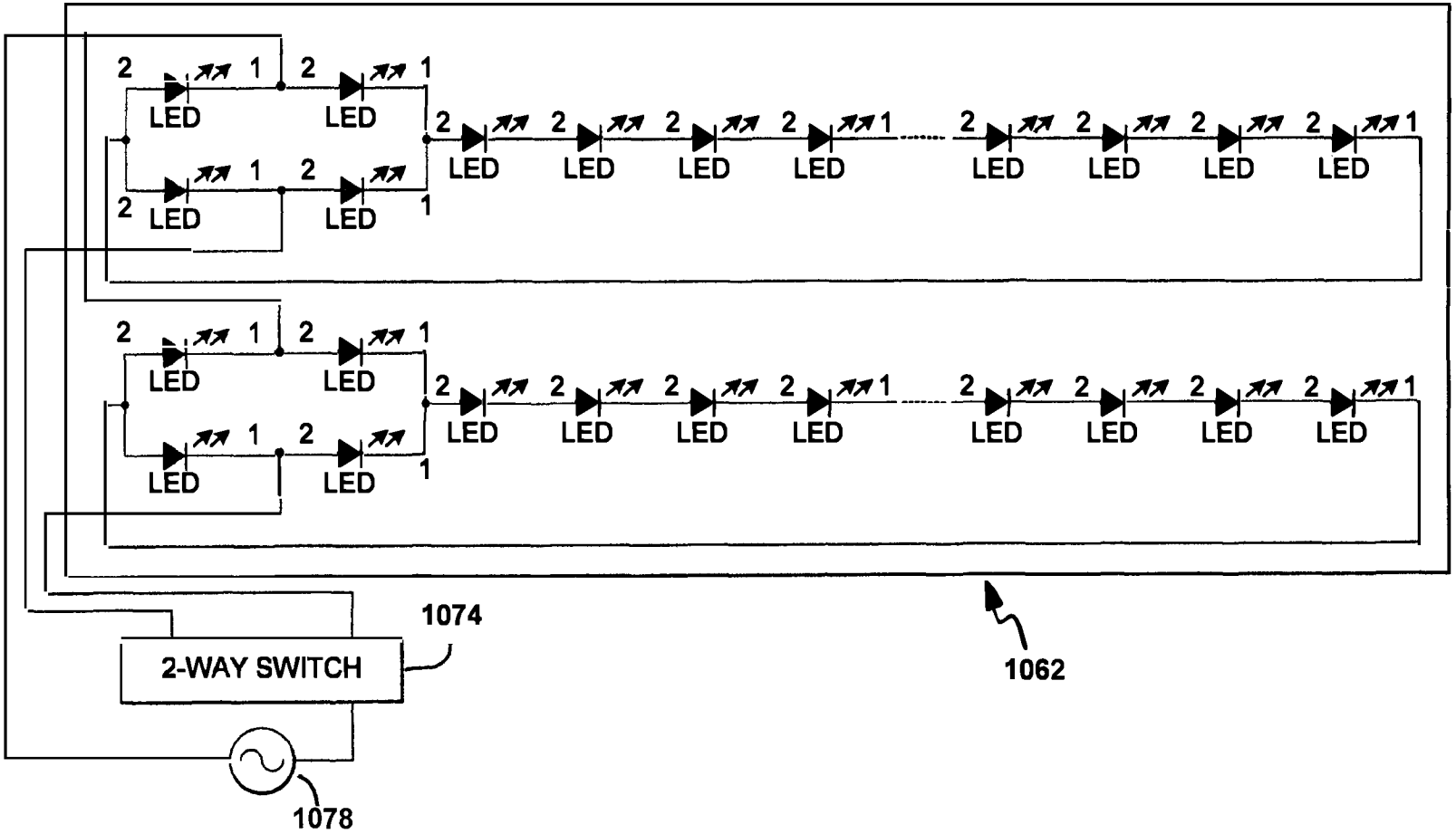
FIG. 13 is a schematic view of a multi-voltage and/or multi-brightness LED lighting device with a switch connected to an AC voltage source, according to an embodiment of the invention.

FIG. 13 discloses a schematic diagram the multi-brightness LED lighting device 1062 with a switch 1074 electrically connected between the multi-brightness LED lighting device 1062 and the AC voltage source 1078.

FIG. 13 discloses a schematic diagram of at least two single voltage LED circuits integrated with a single chip or within a substrate and forming a multi-voltage and/or multi-brightness LED device.

A package in certain applications may preferably also include a heat sink, a reflective material, a lens for directing light, phosphor, nano-chrystals or other light changing or enhancing substances. In some embodiments, an LED circuit includes at least two LEDs. At least one of the at least two LEDs includes a different phosphor coating than that of at least one other LED of the at least two LEDs. In sum, according to one aspect of the invention, the LED circuits and AC drivers of the present invention permit pre-packaging of the LED portion of a lighting system to be used with standardized drivers of known specified voltage and frequency output. Such packages can be of varied make up and can be combined with each other to create desired systems given the scalable and compatible arrangements possible with, and resulting from, the invention.

According to an aspect of the invention, an LED circuit driver provides a relatively fixed voltage and relatively fixed frequency AC output such as mains power sources. The LED circuit driver output voltage and frequency delivered to the LED circuit may be higher or lower than mains power voltage and frequencies by using an LED circuit inverter driver.

The higher frequency LED circuit Inverter driver may be an electronic transformer, halogen or high intensity discharge (HID) lamp type driver with design modifications for providing a relatively fixed voltage as the LED circuit load changes. Meaning if the LED circuit inverter driver is designed to have an output voltage of 12V LED circuit driver would provide this output as a relatively constant output to a load having one or more than one LED circuits up to the wattage limit of the LED circuit driver even if LED circuits were added to or removed from the output of the LED circuit driver.

As would be known to one skilled in the art, various embodiments of the LED packages, substrates, and assemblies may be produced, such as creating an AC-driven circuit where all circuits and LEDs are formed on a semiconductor, where the LED are discretely packaged apart from the circuits, and where each parallel circuit is formed on a printed circuit board.

While in the preceding there has been set forth a preferred embodiment of the invention, it is to be understood that the present invention may be embodied in other specific forms without departing from the spirit or central characteristics thereof The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying Claims.

The invention is claimed as follows:

1. An LED lighting device comprising:

an LED circuit including at least two LEDs that are mounted on a substrate and separated from each other by a distance of 3 millimeters ("mm") or less, wherein at least one of the at least two LEDs includes a different phosphor coating than that of at least one other LED of the at least two LEDs; and a switch configured to be selectable by an end user to enable a change in a color of light emitted from the LED lighting device by causing one of at least a change in brightness or turning 'on' or 'off' the at least one LED with the different phosphor coating of the at least two LEDs in the LED circuit, wherein the switch has at least two positions selectable by the end user, and wherein the substrate and the switch are integrated within the LED lighting device such that the switch is positioned to enable actuation by the end user.

2. The LED lighting device of claim 1, further comprising at least one LED driver circuit configured to:

receive a voltage input from an AC mains power source; and provide a voltage output to at least one of the at least two LEDs that are mounted on the substrate.

3. The LED lighting device of claim 1, wherein the at least two LEDs are electrically connected together in series or in parallel.

4. The LED lighting device of claim 1, further comprising a bridge rectifier mounted to the substrate.

5. The LED lighting device of claim 1, wherein the at least two LEDs of the LED circuit are driven with a voltage of at least 6V.

6. The LED lighting device of claim 1, further comprising a lens cover and a lamp electrical base.

7. The LED lighting device of claim 1, further comprising at least one of:

a voltage level input to the at least one LED with the different phosphor coating that is selectable by the end user via the switch;

a current level input to the at least one LED with the different phosphor coating that is selectable by the end user via the switch; or a brightness level input to the at least one LED with the different phosphor coating that is selectable by the end user via the switch.

8. An LED lighting device comprising:

an LED circuit including at least two LEDs that are mounted on a substrate and separated from each other by a distance of 3 millimeters ("mm") or less, wherein at least one of the at least two LEDs includes a different phosphor coating than that of at least one other LED of the at least two LEDs;

at least one LED driver circuit having a voltage input from an AC mains power source and configured to provide a second lower voltage output to the LED circuit; and a switch configured to be selectable by an end user to enable a change in a color of light emitted from the LED lighting device by causing one of at least a change in brightness or turning 'on' or 'off' the at least one LED with the different phosphor coating of the at least two LEDs in the LED circuit, wherein the switch has at least two positions selectable by the end user, and wherein the LED circuit and the switch are integrated within the LED lighting device such that the switch is positioned to enable actuation by the end user.

9. The LED lighting device of claim 8, wherein the at least two LEDs are electrically connected together in series or in parallel.

10. The LED lighting device of claim 8, further comprising a bridge rectifier mounted to the substrate.

11. The LED lighting device of claim 8, wherein the at least two LEDs of the LED circuit are driven with a voltage of at least 6V.

12. The LED lighting device of claim 8, further comprising a lens cover and a lamp electrical base.

13. The LED lighting device of claim 8, further comprising at least one of:

a voltage level input to the at least one LED with the different phosphor coating that is selectable by the end user via the switch;

a current level input to the at least one LED with the different phosphor coating that is selectable by the end user via the switch; or a brightness level input to the at least one LED with the different phosphor coating that is selectable by the end user via the switch.

14. An LED lighting device comprising:

an LED circuit including at least two LEDs that are mounted on a substrate and separated from each other by a distance of 3 millimeters ("mm") or less, wherein at least one of the at least two LEDs separated from each other by the distance of 3 mm or less includes a different phosphor coating than that of at least one other LED of the at least two LEDs; and a switch configured to be selectable by an end user to enable a change in a color of light emitted from the LED lighting device by causing one of at least a change in brightness or turning 'on' or 'off' the at least one LED with the different phosphor coating of the at least two LEDs in the LED circuit, wherein the switch has at least two positions selectable by the end user, and wherein the LED circuit and the switch are integrated within the LED lighting device such that the switch is positioned to enable actuation by the end user.

15. The LED lighting device of claim 14, further comprising at least one LED driver circuit configured to:

receive a voltage input from an AC mains power source; and provide a voltage output to at least one of the at least two LEDs that are mounted on the substrate.

16. The LED lighting device of claim 14, wherein the at least two LEDs are electrically connected together in series or in parallel.

17. The LED lighting device of claim 14, further comprising a bridge rectifier mounted to the substrate.

18. The LED lighting device of claim 14, wherein the at least two LEDs of the LED circuit are driven with a voltage of at least 6V.

19. The LED lighting device of claim 14, further comprising a lens cover and a lamp electrical base.

20. The LED lighting device of claim 14, further comprising at least one of:

a voltage level input to the at least one LED with the different phosphor coating that is selectable by the end user via the switch;

a current level input to the at least one LED with the different phosphor coating that is selectable by the end user via the switch; or a brightness level input to the at least one LED with the different phosphor coating that is selectable by the end user via the switch.

* * * * *